United States Patent [19]

Okubo et al.

[11] 4,424,743

[45] Jan. 10, 1984

[54] PRINTING DEVICE OF TYPE RING SELECTION SYSTEM

[75] Inventors: Kozo Okubo, Chichibu; Yoshihiro Kobata, Kawasaki; Osamu Asakura, Tokyo; Tatsuo Nishikawa, Tachikawa, all of Japan

[73] Assignees: Canon Kabushiki Kaisha; Canon Denshi Kabushiki Kaisha, both of Tokyo, Japan

[21] Appl. No.: 263,488

[22] Filed: May 14, 1981

Related U.S. Application Data

[63] Continuation of Ser. No. 67,043, Aug. 16, 1979, abandoned.

[30] Foreign Application Priority Data

| | | | |
|---|---|---|---|
| Aug. 19, 1978 | [JP] | Japan | 53-101349 |
| Aug. 19, 1978 | [JP] | Japan | 53-101350 |
| Aug. 19, 1978 | [JP] | Japan | 53-101351 |
| Aug. 19, 1978 | [JP] | Japan | 53-101352 |
| Aug. 19, 1978 | [JP] | Japan | 53-101353 |
| Aug. 19, 1978 | [JP] | Japan | 53-101354 |
| Oct. 27, 1978 | [JP] | Japan | 53-131477 |

[51] Int. Cl.[3] ..... B41J 1/44

[52] U.S. Cl. ..... 101/99; 101/93.22

[58] Field of Search ..... 101/93.29–93.34, 101/93.48, 95, 96, 99, 110, 45; 400/70, 74, 126; 335/261, 262, 270, 276, 279

[56] References Cited

U.S. PATENT DOCUMENTS

| | | | |
|---|---|---|---|
| 2,417,758 | 11/1943 | Immel | 335/276 X |
| 3,076,073 | 10/1960 | Townsend | 335/276 X |
| 3,500,437 | 4/1968 | Foerskr | 400/74 X |
| 3,881,411 | 5/1975 | Araki et al. | 101/45 |
| 3,884,144 | 6/1975 | Shimodaira | 101/99 |
| 4,033,256 | 5/1975 | Hanaoka | 101/99 |
| 4,058,195 | 11/1977 | Fravel et al. | 400/70 X |
| 4,088,216 | 9/1976 | La Manna et al. | 400/70 X |
| 4,096,935 | 8/1976 | Hanakata et al. | 400/120 X |
| 4,104,967 | 11/1977 | Okabe | 101/99 |
| 4,142,463 | 3/1979 | Mitsui et al. | 101/99 |

OTHER PUBLICATIONS

Luoma, IBM Tech Discl. Bulletin, vol. 17, No. 1, June, 1974, pp. 340–341.

*Primary Examiner*—Edward M. Coven

*Attorney, Agent, or Firm*—Fitzpatrick, Cella, Harper & Scinto

[57] ABSTRACT

Improvement in the printing device of a type ring selection system, wherein each independent type ring for each numerical place is rotationally controlled to select a required type on the outer periphery of each type ring at a position opposite to a platen, whereby the types for these numerical places to be printed in one line are aligned and the single line is printed at once with the thus aligned types.

2 Claims, 45 Drawing Figures

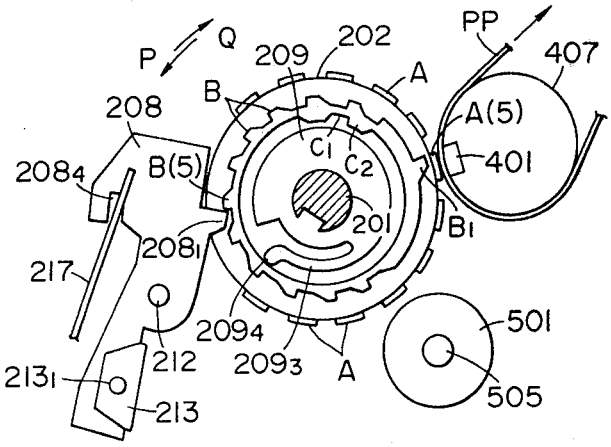
FIG. 13-I
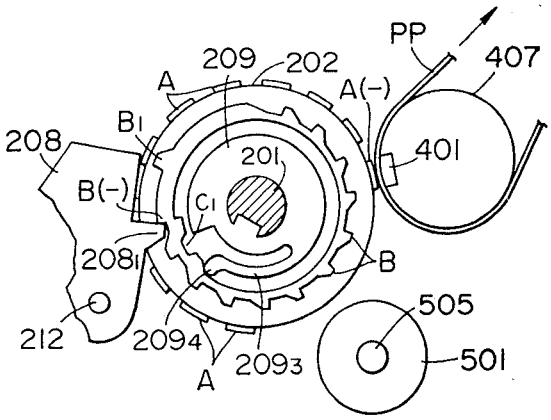
FIG. 13-II
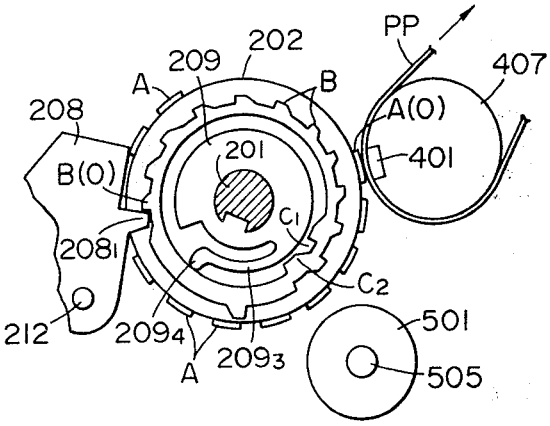
FIG. 13-III

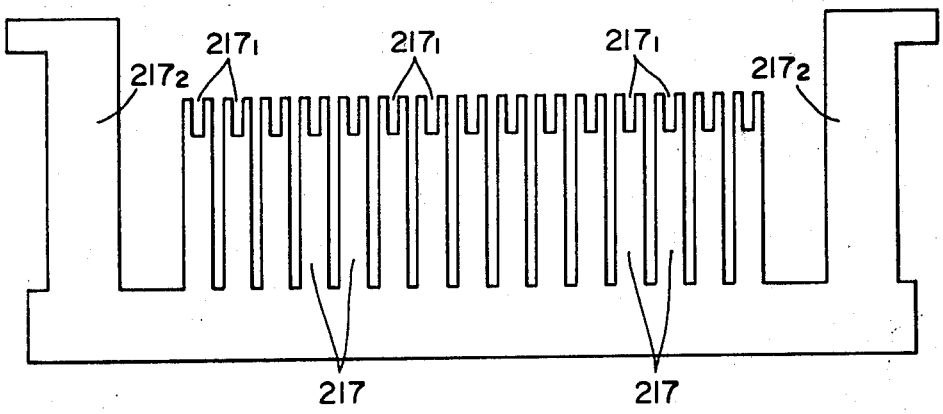
FIG. 16
FIG.17-I
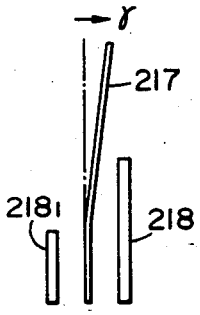
FIG.17-II
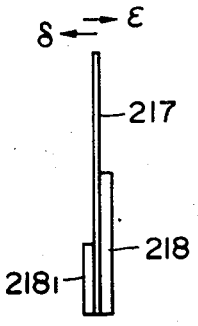
FIG.17-III
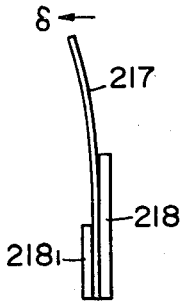
FIG.17-IV
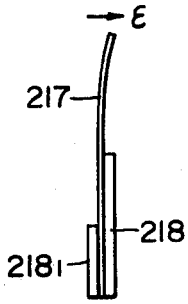
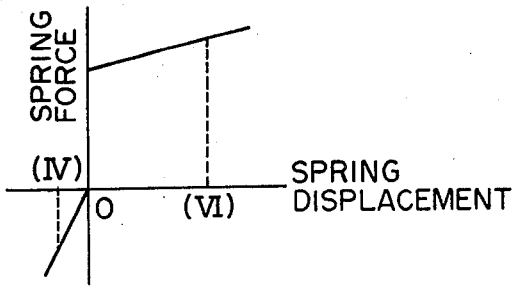
FIG. 18

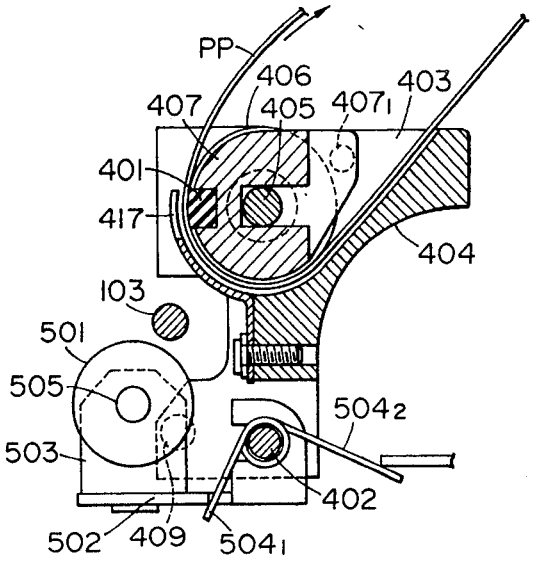
FIG. 21
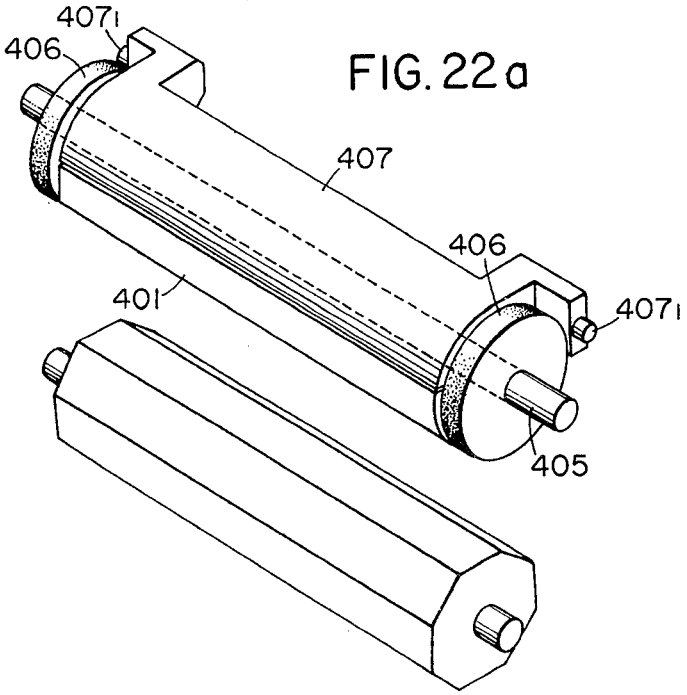
FIG. 22a
FIG. 22b

PRINTING DEVICE OF TYPE RING SELECTION SYSTEM

This is a continuation of application Ser. No. 67,043, filed Aug. 16, 1979, and now abandoned.

BACKGROUND OF THE INVENTION

This invention relates to a character printing device, or a printer, of a type ring selection system, in which an erroneous operation warning mark is provided on the type rings to determine erroneous operations of the printing device.

SUMMARY OF THE INVENTION

It is an object of the present invention to provide an improved printing device of the type ring selection system, in which any erroneous printing can be promptly recognized at a glance upon observing a print format as printed when the erroneous printing occurs due to erroneous operation of the printing device.

It is another object of the present invention to provide such printing device with various improvements such as improvements in the overall mechanical sequence, improvements in an electromagnetic mechanism for the type selection, and various other advantages.

BRIEF DESCRIPTION OF THE DRAWINGS

Various figures of drawing illustrate one preferred embodiment of the printing device according to the present invention, in which:

FIGS. 13(I), 13(II) and 13(III) illustrate various states, wherein the type ring is stopped by the type selection lever to select a desired type in the front face of the platen;

FIG. 16 is a front view of the entire leaf spring;

FIG. 17(I) is a side elevational view showing the leaf spring before it is held between the leaf spring holding lever and a pressing plate;

FIG. 17(II) is a side elevational view showing the initial state of the leaf spring assembled by holding it between the holding lever and the pressing plate;

FIG. 17(III) is a side elevational view showing a displaced state of the leaf spring at the time of selecting a desired character;

FIG. 17(IV) is a side elevational view showing a displaced state of the leaf spring at the time of resetting;

FIG. 18 is a graphical representation showing a relationship between a displaced quantity of the leaf spring and spring force;

FIGS. 19 and 20 are respectively side elevational views showing a relationship between the leaf spring holding lever and an actuating cam for the leaf spring holding lever, in which FIG. 19 shows a compressed state of the leaf spring (in the course of the character selection), and FIG. 20 shows a pressure reduced state thereof (in the course of its returning);

FIG. 21 is a side elevational view, partly in cross-section, showing a mechanical section of the platen;

FIG. 22(*a*) is a perspective view of the platen, platen holder, and paper forwarding rubber roller sections;

FIG. 22(*b*) is also a perspective view of another embodiment of the platen;

FIGS. 23(*b*) and 23(*c*) respectively show the front view and side view of the left and right cams;

DESCRIPTION OF THE PREFERRED EMBODIMENTS

In the following, the present invention will be described in detail in reference to the accompanying drawing.

Figure 1:
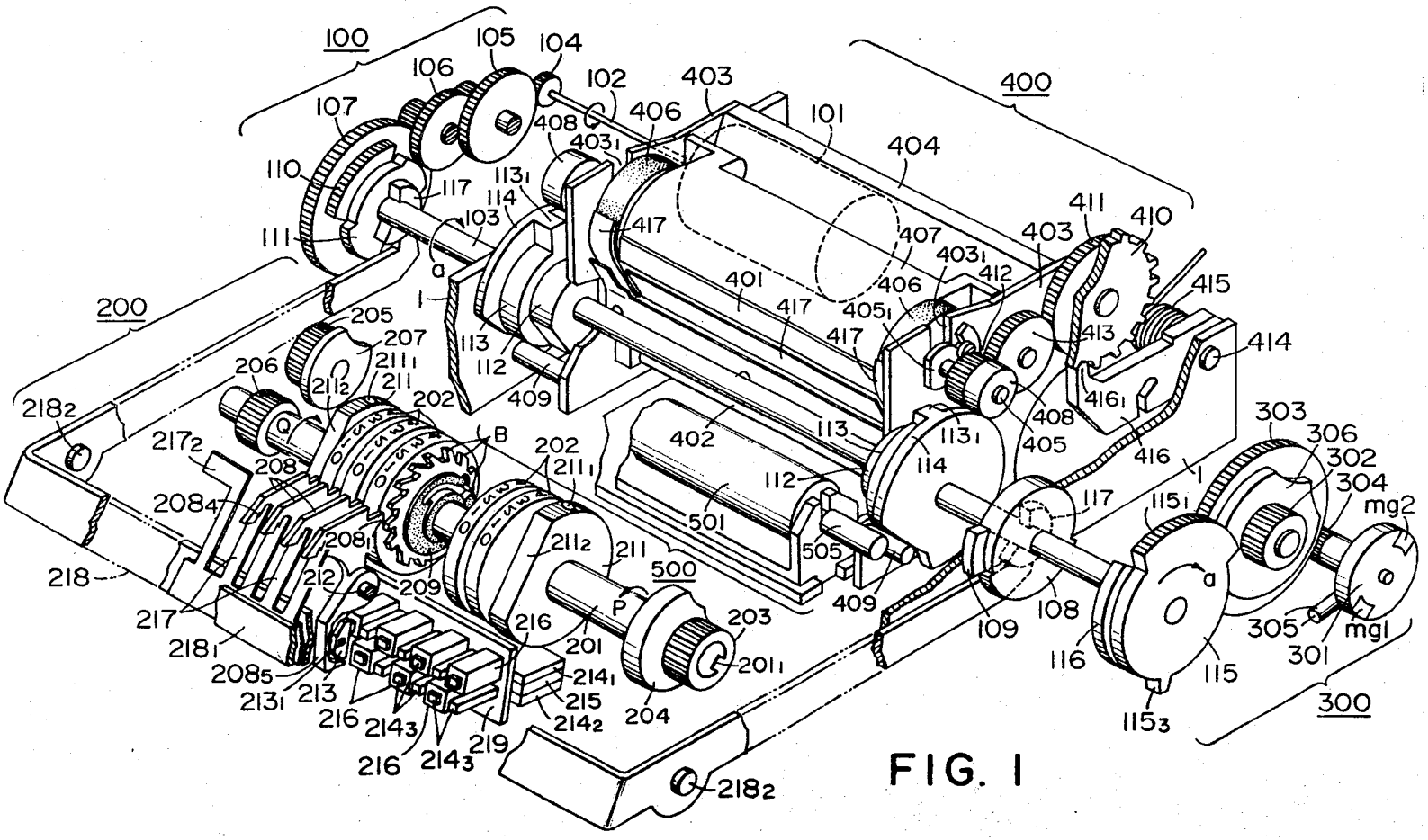
FIG. 1 is an exploded, perspective view showing an outline of the overall printing device according to the present invention.

FIG. 1 is a schematic, exploded, perspective view of one embodiment of the printing device of a type ring selection system according to the present invention. The ensuing explanations will be centered on this illustrated embodiment for the overall structure and operation of the printing device.

Broadly speaking, the printing device in this illustrated construction consists of a drive mechanism 100, a type ring mechanism 200, a signal generating mechanism 300, a platen mechanism 400, and an ink roller mechanism 500.

The drive mechanism 100 comprises a motor 101 fixedly mounted on one of the left and right frames 1, 1 of the printing device with a motor shaft 102 being projected outside the frame, a cam shaft 103 which is rotatably supported on the left and right frame 1, 1 in parallel with the motor shaft 102, a gear train mechanism including a motor gear 104 which transmits rotation of the motor 101 to the cham shaft 103 to rotate the cam shaft 103 in the direction a with a reduction ratio of 49.62:1, speed reduction gears 105, 106, and a cam shaft gear 107, and various other gears and cams 108 to 117, each having the function to control operation of each part of the printing device intensively mounted on the cam shaft 103 as the common drive shaft therefor.

The gear 108 is to forwardly rotate a type ring shaft 201 of the type ring mechanism 200 during the character selection period.

The cam 109 is to maintain the type ring shaft 201 stopped during the printing period.

The gear 110 is to reversely rotate the type ring shaft 201 during the resetting period of the type ring.

The cam 111 is to maintain the type ring shaft 201 stopped during its stand-by period.

A pair of left and right cams 112, 112 are to separate an ink roller 501 of the ink roller mechanism 500 from individual type rings 202 for each place on the type ring shaft 201.

A pair of left and right cams 113, 113 are to press-contact a platen 401 of the platen mechanism 400 to the group of type rings 202.

A pair of left and right cams 114, 114 are to separate the platen 401 from the type ring group 202.

The gears 115, 116 are to operate the signal generating mechanism 300.

A pair of left and right cams 117, 117 are to make variable the pressure of a leaf spring 217 engaged with a type ring selection lever 208 of the type ring mechanism 200.

Figure 2:
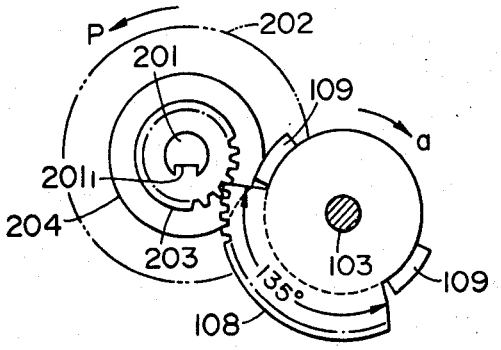
FIG. 2 is a schematic diagram showing the meshed state of gears to forwardly rotate the type ring shaft.
Figure 3:
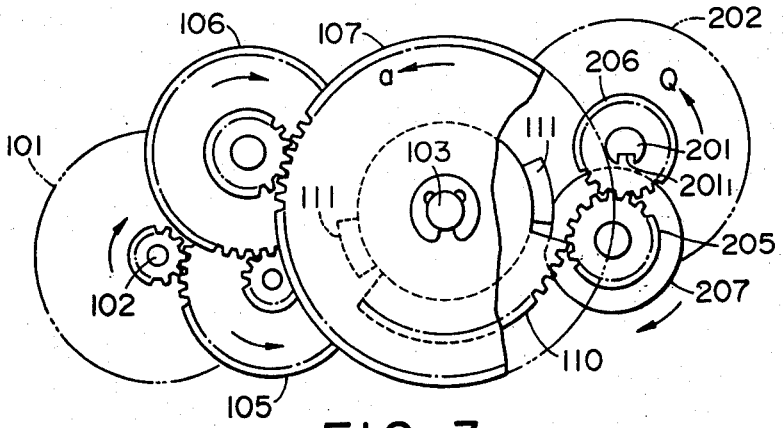
FIG. 3 is a schematic diagram showing the meshed state of gears to reversely rotate the type ring shaft.

In the above-described construction, the gear 108 for rotating forwardly the type ring shaft is a sector gear of approximately 135° of an angle which starts meshing with a gear 203 (FIGS. 1 and 2) integral with the type ring shaft 201 of the type ring mechanism 200 after the motor 101 has started rotation with a print instruction signal and the cam shaft 103 has oscillated for a certain angle. Thereafter, the gear 108 continuously transmits its rotational force to the type ring shaft 201 until the cam shaft 103 oscillates for approximately 135° to become disengaged from the gear 203, thereby rotationally driving the type ring shaft 201 in the forward rotational direction P by about 15/16 (337.5°). With the forward rotation of this type ring shaft 201, the type rings 202 for each place fitted on the shaft 201 start their rotation in the same direction P along with the shaft 201.

Figure 5:
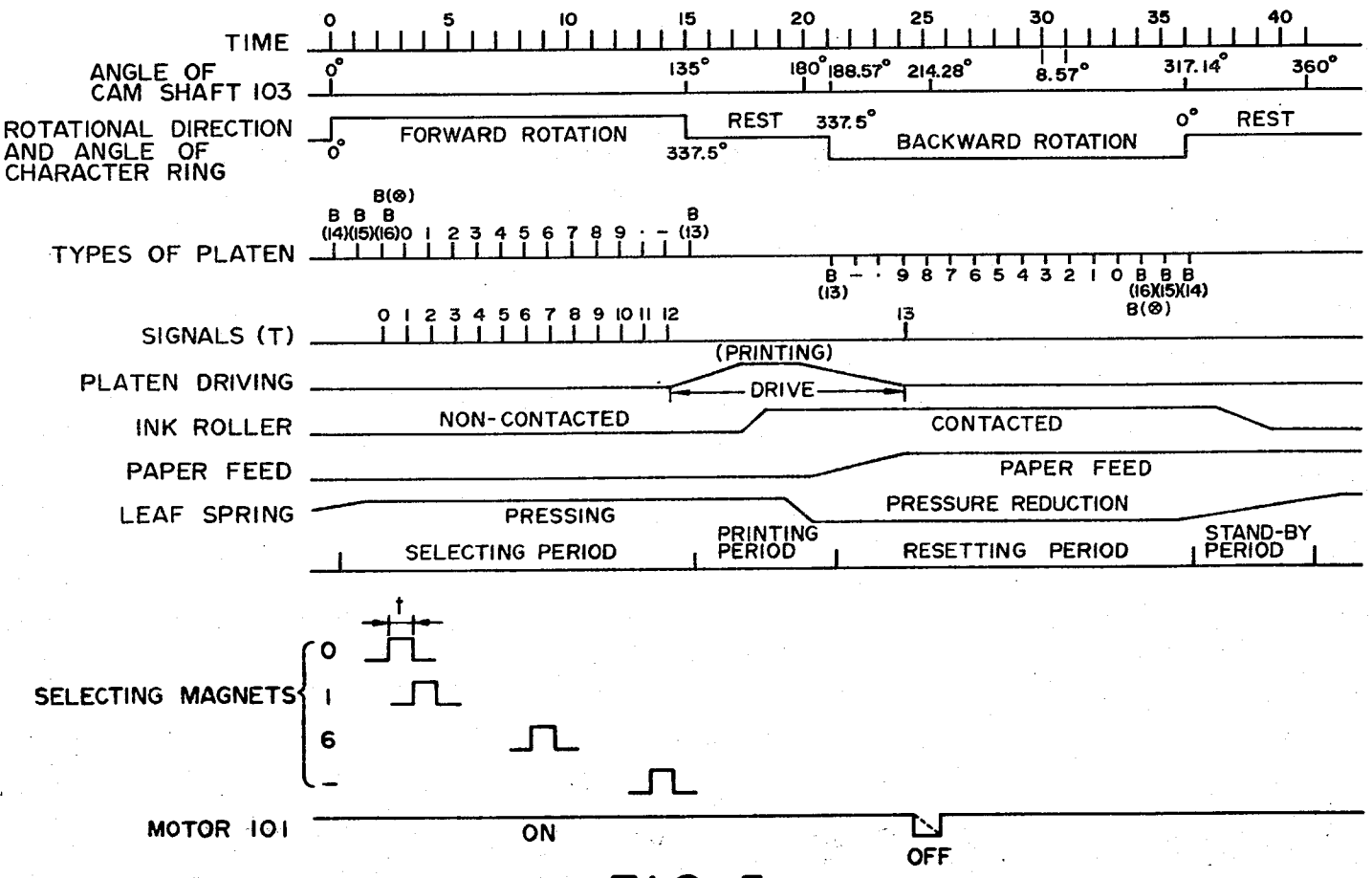
FIG. 5 is a timing chart for the overall printing device.
Figure 6:
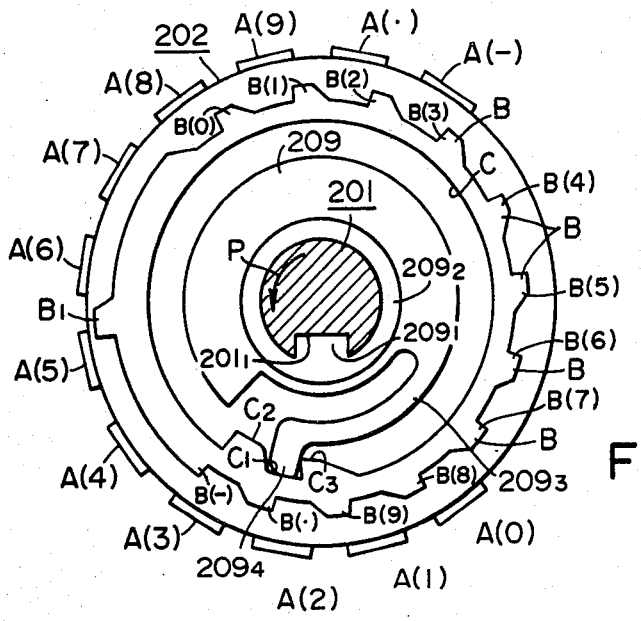
FIG. 6 is an enlarged side elevational view of the type ring.
Figure 7:
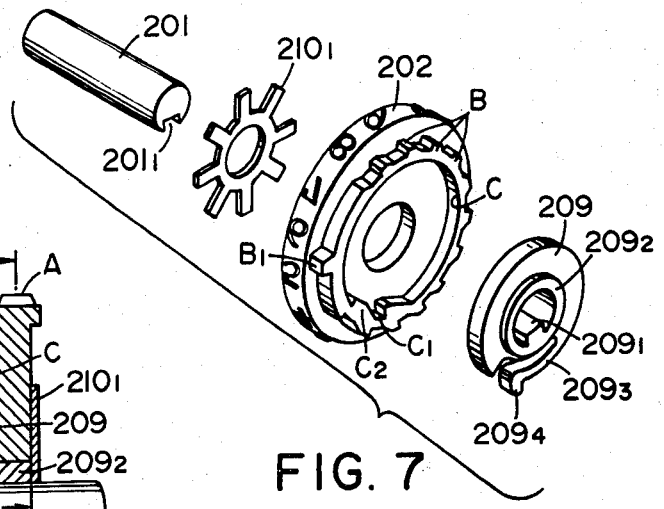
FIG. 7 is an exploded, perspective view of the type ring shown in FIG. 6.

As shown in the timing chart of FIG. 5, this period of forward rotation of the type ring shaft 201 is designated as the character selection period. During this period, when a required type on the outer periphery of each type ring for each of the rotating type rings 202 is rotationally positioned at a position opposite to the platen, a trigger mechanism of the type selection lever 208 corresponding to each of the type rings 202 is actuated by a type selection signal, whereby rotation of each type ring is hindered at that position irrespective of the continued rotation of the type ring shaft 201. In other words, the required type section on the outer periphery of the type ring for each place is selectively positioned opposite the platen, whereby the types to be printed in one line are aligned throughout the entire places.

During the abovementioned character selection period, the platen 401 of the platen mechanism 400 and the ink roller 501 of the ink roller mechanism 500 are held separated from the type ring group 202 by the cams 114, 114 and the cams 112, 112 on the common cam shaft 103.

Incidentally, for the sake of convenience, the timing chart in FIG. 5 has been prepared with the rotational position of the cam shaft 103 as 0° at the time instant when the cam shaft 103 rotates by rotation of the motor 101 based on a print signal, and the gear 108 for forwardly rotating the type ring starts meshing with the type ring gear 203.

The printing period is from disengagement of the gear 108 with the gear 203 until the cham shaft 103 subsequently oscillates by 188.57°. During this period, the cam 109 of the cam shaft 103 is engaged with a positioning cam 204 at the side of the type ring shaft 201, whereby the type ring shaft gear 203 is maintained in a stopped state. Further, during this period, the selected types on the type rings for each place are aligned in the front face of the platen, and the platen 401 press-contacts the type ring group 202 by the cams 113, 113 on the cam shaft 103, whereby print for one line is effected at once onto a printing paper PP (FIG. 21) set on the front face of the platen 401. Subsequently, the platen 401 performs its return motion in the direction away from the type ring group 202 by the action of the cams 114, 114, and paper forwarding for one line is effected. The ink roller 501 of the ink roller mechanism 500 is brought into its press-contacted state with the type ring group 202 by a spring force during the latter half of the printing period by being dissociated from action of the cams 112, 112.

Next, a period after lapse of the printing period until the cam shaft 103 continuously rotates for an angle of 317.14° is designated as the resetting period. During this period, the type ring shaft 201 rotates in the direction Q opposite to that in the character selection period for 15/16 (337.5°). This reverse rotation of the shaft 201 is effected by transmission of the rotational force of the gear 110 for reverse rotation of the type ring shaft (a sector gear of approximately 128.57°) on the cam shaft to a type ring shaft bear 206 constantly meshed with a reset gear 205 through the reset gear 205 supported on the frame 1 in a freely rotatable manner. The reset gear 205 is rotationally driven for 360° in its entirety by the gear 110, and the type ring gear 206 is in a relationship of the gear teeth number which rotates by 15/16 in 360° rotation of the reset gear 205.

During this resetting period, the type rings 202 for each place on the type ring shaft 201 rotate in the opposite direction with the above-mentioned reverse rotation of the type ring shaft 201, and the state wherein the type rings were separately and randomly brought to their oscillatory portions during the character selecting period is brought back to their initial state of their oscillation, whereby the type "0" on the outer periphery of the type rings is reinstated and aligned in the front face of the ink roller 501.

When rotation of the cam shaft 103 proceeds and the gear 110 for the reverse rotation of the type ring shaft disengages from the reset gear 205, i.e., when the reset period is terminated, the positioning cam 111 on the cam shaft 103 subsequently becomes engaged with a positioning cam 207 integrally provided on the reset gear 205 to hold the reset gear 205, i.e., the type ring shaft 201, in a stopped state, thereby entering into the stand-by period.

While, during this stand-by period, the type ring group 202 is stopped, there are still continuing the functions of applying a pressure to the leaf spring 217 engaged with the type selection lever 208 due to continuous rotation of the cam shaft 103 and of separating the ink roller 501 from the type ring group 202, whereby one printing cycle terminates.

The signal generating mechanism 300 (FIGS. 1 and 4) has a function of generating, during the type selection period, signals $T_0$–$T_{12}$ (FIG. 5) corresponding to each type at every time each type on the outer periphery of the type ring passes by the front face of the platen 401, and of generating a signal $T_{13}$ to stop the motor 101 upon termination of the printing step. The electrical signals $T_0$ to $T_{13}$ are generated by operating a reed switch 305 by rotating a disc 301 having permanent magnets $mg_1$ and $mg_2$ by the gear 115 fixedly provided on the cam shaft 103 through intermediate gears 302 to 304.

Figure 4:
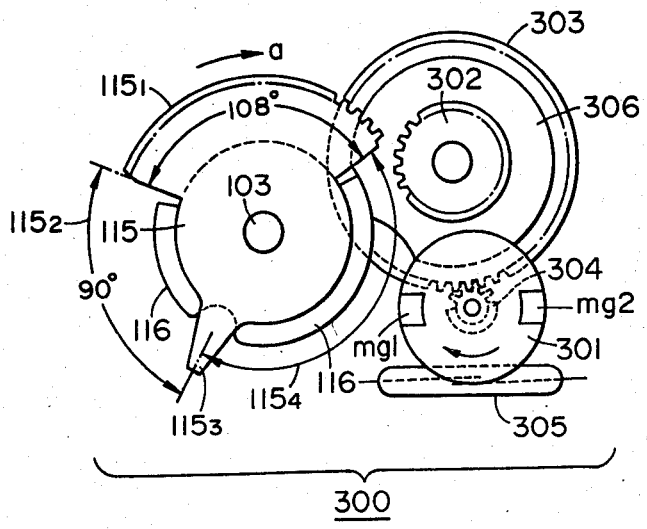
FIG. 4 is a schematic diagram showing the meshed state of gears at a signal generating section.

Since the signal breadth of $T_0$ and $T_{13}$ generated from the reed switch 305 are the same, some contrivance has been made as to varying the signal cycle so as to distinguish the signals $T_0$–$T_{12}$ from $T_{13}$. In other words, as shown in FIG. 4, the gear 115 consists of a sector gear section $\mathbf{115}_1$ in a range of approximately 108° on its circumference for a signal to be generated in correspondence to a type selected in the character selection step, a subsequent section $\mathbf{115}_2$ in a range of approximately 90° on the circumference where the gear teeth are completely removed, a single tooth $\mathbf{115}_3$ following the section $\mathbf{115}_2$ to generate a signal $T_{13}$ when the press-contact of the platen 401 to the type ring 202 has terminated, and the platen 401 is spaced away from the type ring 202, and a remaining section $\mathbf{115}_4$ where the gear teeth are completely removed. The intermediate gear 302 is meshed with the gear section $\mathbf{115}_1$ of the above-mentioned intermittent gear 115, and rotates continuously by approximately 334.2° to thereby rotate the magnet disc 301 through the gear 303 integral with the intermediate gear 302 and the gear 304 of the magnet disc and to actuate the reed switch 305 by the permanent magnets $mg_1$ and $mg_2$ to generate signals $T_0$ to $T_{12}$.

When the gear section $\mathbf{115}_1$ of the intermittent gear 115 disengages from the intermittent gear 302, the positioning cam 116 which is integral with the side surface of the intermittent gear 115 becomes engaged with the positioning cam 306 which is integral with the side surface of the intermittent gear 302. Upon the engagement of the positioning cams, the intermediate gear 302 its stopped and the magnet disc 301 also stops is rotation, whereby the reed switch 305 does not work and no signal is generated.

Thereafter, the cam shaft 103 continuously rotates to pass over the non-toothed section $\mathbf{115}_2$ of the intermittent gear 115, the engagement between the positioning cams 116 and 306 is released, the single tooth section $\mathbf{115}_3$ of the intermittent gear 115 is meshed with the intermediate gear 302 to rotate it for an angle of 25.8° (360°−334.2°=25.8°), whereby the magnet disc 301 rotates for that angle to actuate the reed switch 305 to generate the signal $T_{13}$.

After this, the positioning cams 116 and 306 become engaged again to stop the intermediate gear 302, whereby no signal is generated. In other words, by intermittently rotating the intermittent gear 115 and the intermediate gear 302 in the manner as mentioned above, the signal cycle can be varied.

The foregoing explanations relates to the general construction of the printer according to the present invention and one printing cycle. In the following, detailed explanations will be given as to each mechanical section of the printing device of the present invention.

Type Ring Mechanism 200 (FIGS. 1, 6 to 20)

The type ring 202 for each place is a monolithic mold article having on its outer peripheral surface 12 pieces of type A (in this embodiment, numerals 0 to 9 and auxiliary symbols such as ".", ",", "−") which are arranged at an equal space interval in a section of 12/16; type selection teeth B arranged on the outer periphery of the side surface of the ring in correspondence to each of the types A; a reset projection $B_1$ to determine a position of the type ring 202 for each place with respect to the type ring shaft 201 as well as the platen 401 in contact engagement with the lower part pawl $\mathbf{208}_3$ of the type ring selection lever 208 (FIG. 9); and an arcuate section C concentrical with the type ring 202, a grooved section $C_1$ and a projected part $C_2$ on the inner peripheral surface on the side surface of the type ring.

A reference numeral 209 designates a ratchet for the type ring 202 for each place. The ratchet 209 rotates together with the type ring shaft 201 by mesh-engagement of a ratchet wheel stopper $\mathbf{209}_1$ and a groove $\mathbf{201}_1$ of the type ring shaft 201. On the outer periphery of a boss section $\mathbf{209}_2$ of the ratchet wheel 209, there is fitted the type ring 202 in a manner to oscillate at a angle of 270° or greater. A numeral $\mathbf{209}_3$ refers to a spring section, at the tip end of which there is provided a pawl $\mathbf{209}_4$. These ratchet wheel stopper $\mathbf{209}_1$, the boss part $\mathbf{209}_2$ of the ratchet wheel 209, the spring part $\mathbf{209}_3$ and the pawl $\mathbf{209}_4$ are molded into an integral whole.

Figure 8:
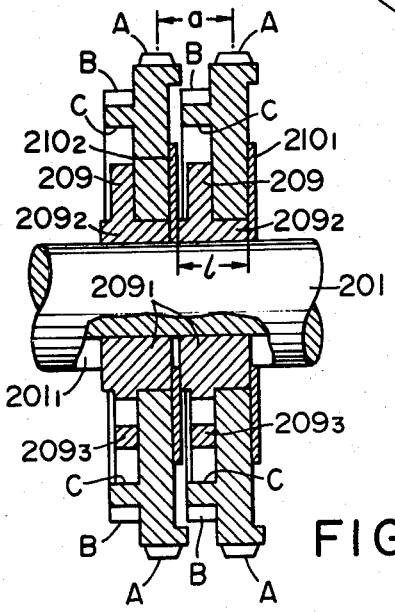
FIG. 8 is a cross-sectional view of the type ring shown in FIG. 6.

A pitch a in the direction of the numerical place of the type rings 202 is definitely maintained by the width l of the boss part $\mathbf{209}_2$ of the ratchet wheel 209 and a spring washer 210 (FIG. 8).

The number of type rings for incorporation on the type ring shaft 201 is restricted at both sides by stopper members 211, 211 (FIG. 1), whereby the horizontal movement along the type ring shaft 201 is hindered. The stopper members 211, 211 are fixed on the type ring shaft 201 by means of stopper screws $\mathbf{211}_1$, $\mathbf{211}_1$. It is also feasible that the stopper members 211, 211, be fixed on the shaft 201 in utilization of the groove $\mathbf{201}_1$ of the type ring shaft 201, although, in this case, thrust stopper rings are required.

The stopper members 211, 211 have the same outer diameter as the type rings 202, and function to auxiliarily transmit rotation of the type ring shaft 201 to the ink roller 501 by contacting both end parts of the ink roller 501 when the ink roller 501 contacts the group of type rings. Further, on the outer periphery of the stopper members 211, 211, there are provided escapement sections $\mathbf{211}_2$, $\mathbf{211}_2$ for the platen 401 at the time of printing operation, thereby preventing the printing paper PP (FIG. 21) wound around the platen from being stained by contacting the outer surface of the stopper member 211, 211.

In case the type ring shaft 201 rotates in the above-mentioned forward direction P, the pawl $209_4$ transmits, without failure, to the type ring 202 the rotation in the direction P of the type shaft 201, when it is engaged with the groove $C_1$ of the type ring 202. Also, an escapement angle of 9° is given to the pawl $209_4$ so that, when the upper surface $208_2$ of the pawl $208_1$ of the type ring selection lever 208 becomes engaged with the teeth B at the side of the type ring 202, the pawl $209_4$ may get out of the groove $C_1$ of the type ring 202 due to flexure of the spring section $209_3$ and that it may not transmit the rotation to the type ring 202.

When the type ring shaft 201 rotates reversely in the direction Q, the pawl $209_4$ contacts and engages with the projected part $C_2$ on the inner periphery of the side part of the type ring 202, and the type ring 202 rotates along with the shaft 201 without failure.

As already explained in the foregoing driving mechanism 100, rotation of the motor 101 is transmitted to the type ring gear 203 by a print instruction, whereby the type ring shaft 201 rotates in the forward direction P. At this time, since the pawl $209_4$ of the ratchet wheel 209 of the type ring 202 for each place is engaged with the grooved portion $C_1$ of the type ring 202, the rotation of the type ring shaft 201 is transmitted to the type ring 202 through the pawl $209_4$ and the groove $C_1$. In this case, the ink roller 501 is spaced apart from the group of the type rings, hence no rotational resistance from outside works on the type ring group. As the consequence, the type rings 202 for all numerical places are aligned and rotate in the forward direction P together with the shaft 201.

When the type ring 202 for each place rotates in the direction P and a desired type at a predetermined place arrives just in front of the platen 401 for printing, a trigger mechanism (to be described later) of the type ring selection lever 208 is actuated by the type selection signal, whereby the pawl part $208_1$ of the type ring selection lever 208 engages the front of the selection teeth B corresponding to the type to be printed. When the type ring 202 continuously rotates in the direction P and the upper part $208_2$ of the pawl $208_1$ of the type ring selection lever 208 contacts the selection teeth B, the type ring 202 stops its rotation.

Upon stoppage of rotation of the type ring 202, the pawl part $209_4$ of the ratchet wheel 209 which is rotating in the direction P together with the type ring shaft 201 runs over the projected part $C_3$ of the type ring 202 due to flexure of the spring part $209_3$, and is released from its engagement with the consequence that it rotates in the region of the arcuate section C without transmitting the rotation to the type ring 202. Force required for the pawl part $209_4$ to run over the groove portion $C_1$ is received at the upper part $208_2$ of the pawl on the type ring selection lever 208.

Thereafter, the type ring shaft 201 rotates for 337.5°, and stops. During this period, there is performed selection of all the types to be printed in the type ring for each place, and these selected types for one line are aligned in front of the platen 401, whereby the type selection period is over.

Incidentally, no type is positioned at a portion opposite to the platen 401 of the type ring 202 in the numerical place where no print is to be made. The notched portions $211_1$, $211_1$ of the stopper members 211, 211 confront to the platen 401.

Upon completion of the above-mentioned character selection period, the platen mechanism 400 starts operation, wherein the platen 401 is urged to the type face for one line as aligned, and print is done on the surface of the printing paper wound around the platen 401. At the same time, the ink roller 501 of the ink roller mechanism 500 enters into the contact state with the type ring group. Further, the type ring selection lever 208 is reset to its initial stand-by position due to the pawl $208_1$ being disengaged from the type ring selection teeth B by the reset mechanism.

When the platen 401 is spaced apart from the type ring group 202, and the pawl $208_1$ of the type ring selection lever 208 is disengaged from the teeth B at the side of the type ring 202, the type ring shaft 201 is reversely rotated in the direction Q by the reversely rotating gear mechanism 110, 205, and 206 (FIGS. 1 and 4) of the driving mechanism 100, whereby the type ring for each place reversely rotates therealong. In this instance, since the type ring which has not been selected during the character selecting period remains to be engaged with the grooved portion $C_1$ and the pawl portion $209_4$ of the ratchet wheel 209, the type ring is forcibly rotated in the direction Q together with the ratchet wheel 209 by the engagement of the pawl portion $209_4$ of the ratchet wheel 209 rotating in the direction Q together with the type ring shaft 201 and the projected part $C_2$, whereby it is returned to the initial position prior to rotation.

At this time, the ink roller 501 is rotated by friction between the type ring rotating in the direction Q and the stopper members 211, 211 integral with the type ring shaft 201, and applies ink onto the type face of the type rings 202, while it is roll-contacting to the type rings.

Further, the type rings selected in the course of the character selecting operation is not engaged with the pawl portion $209_4$ of the ratchet wheel 209 and the grooved portion $C_1$ of the type ring, hence the pawl portion $209_4$ is unable to transmit rotation to the type ring, although it is rotated in the direction Q due to friction between the ink roller 501 as rotated in the above manner and the outer periphery of the boss part $209_2$ of the ratchet wheel 209. The type ring reaches its initial stand-by position in advance of the type ring which has not been selected. Therefore, the reset projection $B_1$ contacts the lower part $208_3$ of the pawl of the selection lever 208 which has already returned to the stand-by position, at which position its rotation is stopped.

At this time, the type A is rubbed by the ink roller 501. And, as soon as the pawl portion $209_4$ of the ratchet wheel 209 rotating in the direction Q drops into the grooved section of the abovementioned stopped type ring, transmission of rotation from the driving mechanism 100 to the type ring shaft 201 is interrupted. Since the type rings 202 for all numerical places are exactly positioned by contact of the lower part $208_3$ of the pawl of the section lever 208 and the reset projection $B_1$, they do not pass over the initial stand-by position by its inertia.

Incidentally, application of ink onto the type rings which have been selected during the printing step starts after three positions in the selection direction of the type as selected. Therefore, while ink is not applied onto all types at every printing cycle, the printing speed can be increased thereby.

As stated above, when the type rings for all numerical places return to their initial stand-by position, the ink roller 501 is again spaced apart from the type ring group.

Through the abovementioned steps, one print cycle is completed, and the printing device again enters into its print stand-by state.

In case the empty paper forwarding is done by a mechanical sequence, the type ring shaft 201 rotates reciprocatively (i.e., both forwardly and reversely) in the directions P and Q, whereby the platen 401 becomes near to the type ring 202 through the printing paper PP at the print timing. However, since the type ring selection lever 208 does not operate, and the pawl portion $\mathbf{209}_4$ of the ratchet wheel 209 and the grooved portion $C_1$ of the type ring 202 remain engaged, there exists no type at a position where the platen 401 and the type ring 202 face each other, whereby nothing is printed on the printing paper PP.

Type Selection Electromagnetic Mechanical Part (FIGS. 1, 9 to 20)

The type selection lever 208 corresponding to the type ring 202 for each place is supported on a single common shaft 212 (FIG. 1) in a freely oscillatable manner, and has the pawl portion $\mathbf{208}_1$ confronting the teeth B of each type ring 202 and an armature 213 pivotally supported on a shaft pin $\mathbf{213}_1$ on the opposite side of the pawl portion $\mathbf{208}_1$ with respect to the single common shaft 202 in a freely rotatable manner.

Reference numerals $\mathbf{214}_1$ and $\mathbf{214}_2$ designate upper and lower comb toothed yokes having an equal number of toothed sections $\mathbf{214}_3$ as the number of places. Between the yokes $\mathbf{214}_1$ and $\mathbf{214}_2$, there is interposed a permanent magnet plage 215 to render the yokes $\mathbf{214}_1$, $\mathbf{214}_2$ to have the poles N and S. A winding 216 is provided on the comb toothed part in a checkered form as shown in FIG. 1, and further, another comb toothed section $\mathbf{214}_3$ is disposed in a manner to oppose the armature 213 of the type selection lever 208.

A reference numeral 217 designates a leaf spring which is engaged with the leaf spring holding lever 218 in such a manner that it energizes the type selection lever 208 in the direction where the pawl portion $\mathbf{208}_1$ is meshed with the tooth B of the type ring 202 at the time of the type selection, and it energizes the armature 213 in the direction where it is press-contacted to the yoke tooth portion $\mathbf{214}_3$ at the time of resetting. The leaf spring oscillates with the rotational shaft $\mathbf{218}_2$ as its center of oscillation by means of leaf spring force variable cams 117, 117 (FIG. 1) fixedly secured to the cam shaft 103 through the leaf spring holding lever 218.

Figure 9:
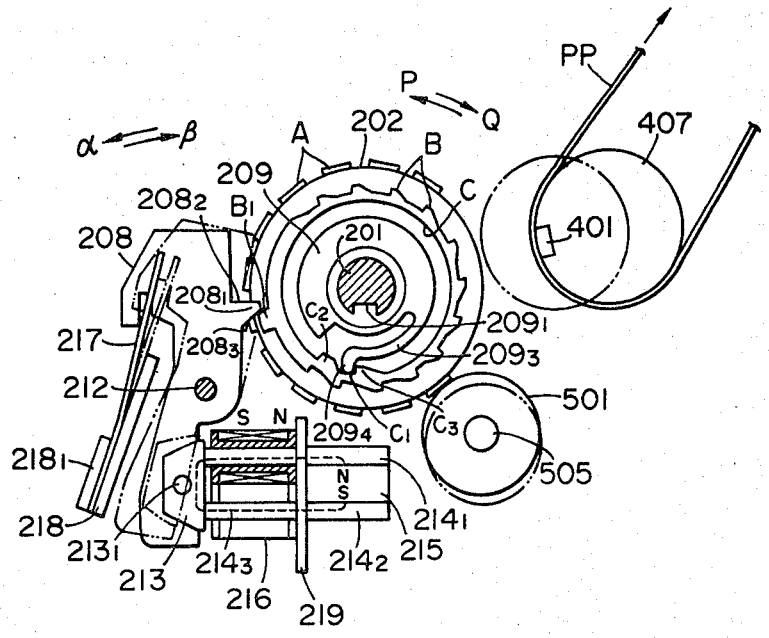
FIG. 9 shows a positional relationship between the type ring and a type selection lever.

FIG. 9 shows the print stand-by state, in which, when the printing device enters in the character selection period and the type ring shaft 201 starts its forward rotation in the direction P, the selection lever 208 for each place is energized in the direction of an arrow $\alpha$ by the leaf spring 217 with the shaft 212 as the center of rotation, although the lever is held at a position in solid line in the drawing, because the armature 213 is attracted to and held by the comb toothed section $\mathbf{214}_3$ of the magnetized yokes $\mathbf{214}_1$ and $\mathbf{214}_2$, whereby the type ring 202 for each place synchronously rotates in the forward direction P with the shaft 201 through the ratchet wheel 219.

When the designated type arrives at a position opposite the platen 401 by rotation of the type ring, electric current is supplied through the coil 216 and the magnetic flux of the comb teeth $\mathbf{214}_3$, $\mathbf{214}_3$ of the yoke to hold the armature 213 is interrupted, whereby the type selection lever 208 rotates in the direction of the type ring 202 with the shaft 212 as the center of rotation by spring force of the leaf spring 217 as shown by a chain line in the drawing, whereby the type ring 202 is stopped in its rotation as that the designated type on its outer periphery confronts to the platen 401. FIG. 13(I) to 13(III) respectively illustrate those states, wherein a type "5", a type "—", and a type "0" have been selected. Even after the type ring 202 is engaged with the type selection lever pawl $\mathbf{208}_1$, as mentioned above, the ratchet wheel 209 continuously rotates with the type ring shaft 201, the pawl $\mathbf{209}_4$ of the ratchet wheel 209 gets off the projection $C_3$ of the type ring 202 to disconnect the type ring from the ratchet wheel, and the type ring shaft 201 rotates for a predetermined angle and stops, whereupon the ratchet wheel 209 also stops.

Thus, the abovementioned required type selection operation is effected onto each type ring for each place, whereby the types for one line of print are aligned in front of the platen 401.

Next, the platen 401 which holds thereon the printing paper PP moves toward the aligned types, and urges the printing paper PP to the type faces to perform the printing. As soon as the platen 401 which has been subjected to printing commences its return to the stand-by position, the leaf spring 217 oscillates in the arrow direction $\alpha$ in FIG. 9, and the type selection lever 208 for each place is reset to the initial position.

When the resetting of the type selection lever 208 is complete, the type ring shaft 201 starts its return rotation (in the direction Q), and the pawl $\mathbf{209}_4$ of the ratchet wheel 209 of the type ring for each place is again engaged with the grooved portion $C_1$ of the type ring 202, whereby resetting of the type ring group is effected. In the course of resetting the type ring, the ink roller 501 is urged to the type ring group to feed ink onto the types which have performed printing.

The electromagnetic mechanism to oscillate the type selection lever 208 for each place is composed, as mentioned above, of the yokes $\mathbf{214}_1$, $\mathbf{214}_2$, the permanent magnet 215, the coil 216, and the printing plate 219.

Figure 14:
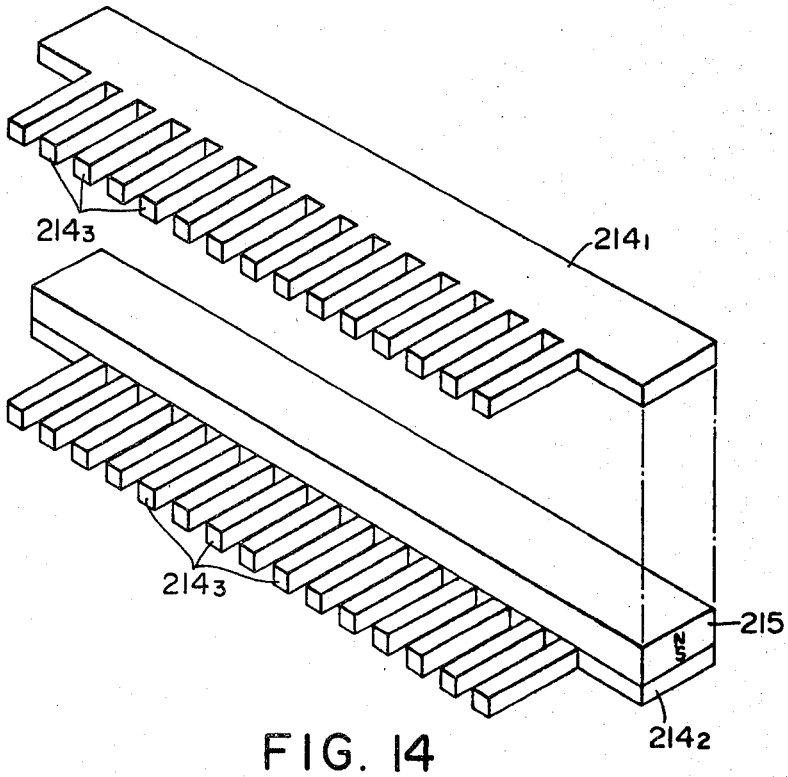
FIG. 14 is an exploded, perspective view of yokes.

The yokes $\mathbf{214}_1$, $\mathbf{214}_2$ are in the shape of comb teeth as shown in FIG. 14, and are assembled together with the permanent magnet 215 being interposed at the root section of the comb teeth, whereby the yokes $\mathbf{214}_1$, $\mathbf{214}_2$ constitute N and S of the magnetic poles.

For the permanent megnet 215, a ferrite-plastic magnet is used. Since, however, the ferrite-plastic magnet is liable to vary its magnetic force to a remarkable extent due to temperature variations, if a temperature compensation is required, there may be used a magnet made of rare earth cobalt plastic magnet, non-plastic ceramic ferrite, rare earth cobalt, alnico, etc., although these materials are poor in their processability.

The printing plate 219 is inserted into the comb toothed section of the assembled yokes $\mathbf{214}_1$, $\mathbf{214}_2$ in lamination, and the coil 216 is further inserted in checkered form, as shown in FIG. 1.

Figure 15:
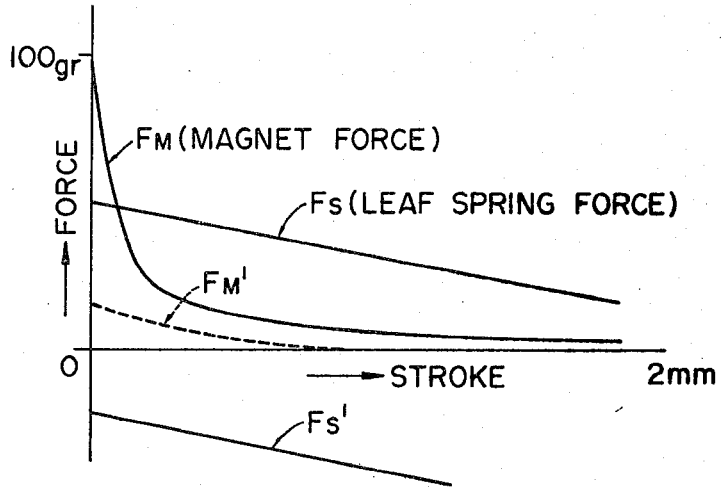
FIG. 15 is a graphical representation showing a relationship between the attractive force a magnet and the force of a leaf spring.

The yokes $\mathbf{214}_1$, $\mathbf{214}_2$ constituting the magnetic poles attracts and holds the armature 213 pivotally supported on the type selection lever 208 energized in the arrow direction $\beta$ by the leaf spring 217 against force of the spring 217, as shown in FIG. 9. FIG. 15 shows its power relationship. In the drawing $F_M$ denotes magnet attracting force acting on between the yokes $\mathbf{214}_1$, $\mathbf{214}_2$ and the armature 213, and $F_S$ denotes the spring force by the leaf spring 217. In the stand-by state, the magnet attracting force $F_M$ is made greater than the spring force $F_S$ at the zero stroke.

When selecting the type ring 202, if the coil 216 provided on the yokes 214$_1$, 214$_2$ is subjected to current conduction so as to attain the polarity as shown in FIG. 9, the magnetic flux passing through the yoke 214$_1$→the armature 213→yoke 214$_2$ is reduced, whereby the magnet attracting force $F_M$ becomes weakened to $F'_M$ as shown in FIG. 15, whereby the spring force $F_S$ becomes greater. As the result of this, the type selection lever 208 rotates in the direction of the type ring 202 with the shaft 212 as the center of its rotation as indicated by the chain line in FIG. 9 and FIGS. 13(I) to 13(III) to engage the pawl 208$_1$ of the lever 208 with the tooth B of the type ring 202, whereby the type ring is stopped.

When the printing is ended and the device enters into the type ring return step, the leaf spring holding lever 218 is rotated in the arrow direction λ (FIG. 20) and the type selection lever 208 is energized in the arrow direction β by the leaf spring 217$_2$. The spring force at that time is denoted by $F'_S$ in FIG. 15. The type selection lever 208 is reset by this spring force $F'_S$ and the armature 213 is again brought to the state shown by the solid line in FIG. 9 as it is attracted and held by the yokes 214$_1$, 214$_2$, to wait for the next printing operation.

As mentioned in the foregoing, the type selection lever 208 for each place is rotatably supported on the common shaft 212 manner, and is arranged in such a manner that it may correspond to each type ring 202 for each place.

The type selection lever 208 has the pawl portion 208$_1$ to be meshed with the teeth B provided at the side surface of the type ring 202 at a position confronting to the teeth B. In the type selection step, the lever 208 is energized by the leaf spring 217 in the arrow direction β in FIG. 9, while, in the return step, in the arrow direction α. On account of this, the engaging part 208$_4$ of the lever 208, where it is engaged with the leaf spring 217, is notched so that it may receive force in both α and β directions as in FIG. 9.

Figure 10:
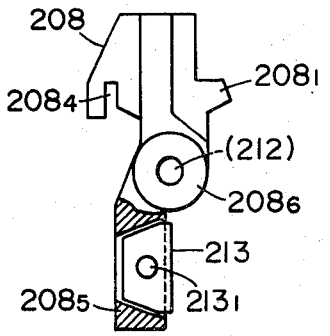
FIG. 10 is a side view, partly cut away, of the type selection lever.
Figure 11:
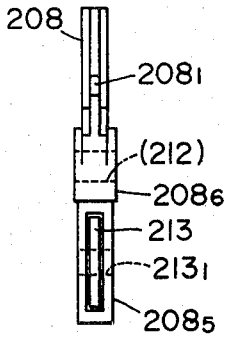
FIG. 11 is a front view of the type selection lever shown in FIG. 10.
Figure 12:
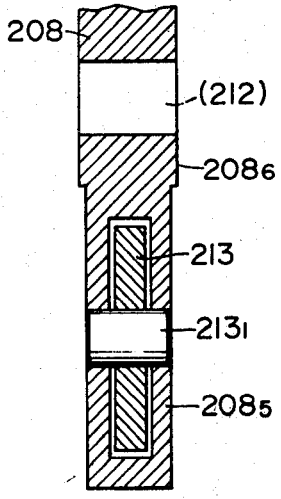
FIG. 12 is an enlarged, longitudinal cross-section of an armature section of the type selection lever.

Further, the armature 213 is supported on the shaft 213$_1$ in a freely rotatable manner at a position confronting to the yokes 214$_1$, 214$_2$. Furthermore, as shown in FIGS. 10 to 12, a play is given for axial supporting the armature 213. In so doing, any error in working and assembling of the parts is absorbed by the rotation or play of the armature at the time of attraction and holding of the armature 213 to the yokes 214$_1$, 214$_2$ to thereby attain perfect intimate contact of the armature 213 to the yokes 214$_1$, 214$_2$, which provides strong and stable attraction and holding force. In more detail, the armature 213 is fitted on the shaft 213$_1$ with a fairly large clearance between them as shown in FIG. 12. Also, the armature case 208$_3$ of the type selection lever 208 is provided with a certain amount of clearance in the thrust direction of the armature 213, when the armature is inserted into the case.

While the armature 213 is rotatably supported on the shaft 213$_1$, if its rotational quantity is large, there takes place a large relative movement when the armature 213 follows the surface of the yokes 214$_1$, 214$_2$ at the time of its attraction to the yoke with the result that both parts are subjected to considerable wear. Also, when the armature 213 rotates for 90°, the attracting surface of the armature 213 is no longer attracted to the yokes 214$_1$, 214$_2$. Therefore, as shown in FIG. 10, the rotational quantity of the armature 213 is made to be the minumum necessary depending on the configuration of the armature case section 208$_5$ of the type selection lever 208.

As mentioned above, the type selection layer 208 is of a somewhat complicated shape in order to provide various functions. In the illustrated embodiment, each of the type selection levers 208 is formed in a plastic mold and made an integral part of the boss 208$_6$ of the bearing part.

The leaf spring 217 which energizes the type selection lever 208 for each place in both the selection direction β and the reset direction α has a comb toothed spring section corresponding to the number of places, as an integral construction, as shown in FIG. 16.

At the tip end part of the comb toothed spring section 217, there is provided a groove 217$_1$. By engaging the notched part 208$_4$ (FIG. 10) of this type selection lever 208 with this groove, the type selection lever 208 is arranged with the comb toothed pitch of the leaf spring 217. The groove 217$_1$ has a function of positioning and guiding the lever 208 so that it may not oscillate.

The comb toothed spring section 217 of the leaf spring is initially deformed in the arrow direction γ in an unloaded state, as shown in FIG. 17(I). The initial tension is obtained by assembling it by holding between the leaf spring holding lever 218 and the spring pressing plate 218$_1$ as shown in FIG. 17(II). FIG. 17(III) shows a displaced state of the spring when the spring changes from its initial state shown in FIG. 17(II) to the type selection state, and FIG. 17(IV) shows the state in its reset state. FIG. 18 shows a relationship between the spring force in each state shown in FIGS. 17(II) to 17(IV) and the displacement quantity of the spring. As is understandable from FIG. 18, by imparting the initial tension to the leaf spring 217 as in FIG. 17(I), a large force is obtained even with a small stroke, and the variation in the spring force can be made small even with variations in the stroke.

Moreover, even when a force is applied to the resetting direction ε, the spring force becomes abruptly zero at the time instant when the leaf spring 217 contacts the leaf spring holding lever 218, whereby it becomes possible to change the spring force over to that in the resetting direction with a slight rotation in the direction ε.

As shown in FIG. 16, the spring 217$_2$ at both end parts of the leaf spring plate in the comb teeth configuration is in the shape of a letter "L", and is engaged with the side plates 1, 1 of the printing device (FIG. 1). It is so constructed that a spring force in the resetting direction may always be imparted to the leaf spring holding lever 218.

Figure 19:
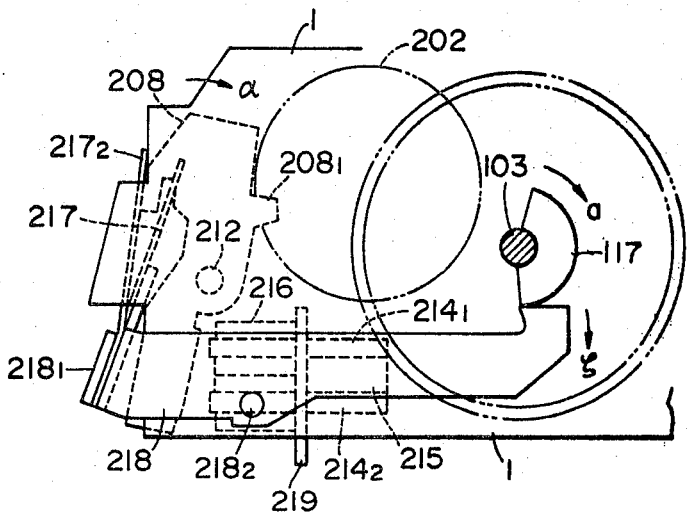
Figure 20:
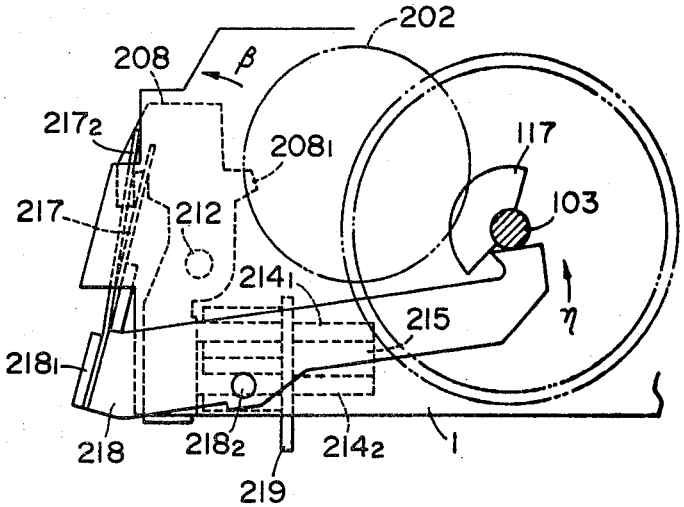

FIGS. 19 and 20 illustrate a spring force variable mechanism for the abovementioned leaf spring 217, wherein the lever 218 which holds the leaf spring is supported for oscillatory movement on the side plates 1, 1 of the printing device with the shafts 218$_2$, 218$_2$ as the center of oscillation. The free ends at the left and right of the lever 218 are constantly held in a contact state by force of the return springs 217$_2$, 217$_2$ at both end sides of the leaf spring to a pair of lever oscillating cams 117, 117 fixedly secured to the cam shaft 103 of the driving mechanism 100 (FIG. 1).

In the type selection step, the leaf spring holding lever 218 is rotationally energized by the cam 117 in the arrow direction θ with the shaft 218$_2$ as the center of oscillation against force of the return spring 217$_2$ of the leaf spring, as shown in FIG. 19. The type selection lever 208 is energized in the arrow direction β by the comb toothed spring section of the leaf spring 217 held on the leaf spring holding lever 218.

When the type selection and the printing are completed, and the printing device enters into its return step, the cam 117 rotates to the position in FIG. 20 by the rotation of the cam shaft 103. On the other hand, the leaf spring holding lever 218 is energized to rotate in the arrow direction λ by the return spring $217_2$ with the shaft $218_2$ as the center of rotation, thereby imparting a reset energizing force in the arrow direction α to the type selection lever 208 for each place to thereby effect the resetting.

Platen Mechanism 400 (FIGS. 1, 21 to 26)

The platen mechanism comprises a pair of left and right platen levers 403, 403 supported in a freely rotatable manner on a shaft 402 which is supported in parallel with the cam shaft 103 between the side plates 1, 1 of the printing device; a laterally extending plate 404 to integrally connect the left and right platen levers; a rotational shaft 405 supported in a freely rotatable manner on the left and right platen levers 403, 403; a pair of left and right paper feeding rubber roller 406, 406 fixedly secured to the abovementioned rotational shaft 405 inside each of the platen levers 403, 403; a platen holder 407 loosely supported on the rotational shaft 405 between the rubber rollers 406, 406; a platen 401 held in front of the side of the type ring mechanism 200 of the holder 407; a pair of left and right platen lever reciprocating rollers 408, 408 fixedly secures at both ends of the rubber roller shaft 405; a pair of left and right platen lever reciprocating pins 409, 409; a ratchet wheel 410 fitted in a freely rotatable manner on the outer surface of one of the platen levers 403, 403; a gear 411 integrally formed with the ratchet wheel 410; an intermediate gear 413 meshed with a gear 411 and a gear 412 integrally fixed to the rubber roller shaft 405; and a pawl member 416 supported on one side plate 1 of the printing device in a freely rotatable manner with a shaft 414 as the center of rotation and being in constant contact with the ratchet wheel 410 by means of a coil spring 415.

In order to prevent it from rotating with the rotational shaft 405 as the center of rotation and from slipping in the direction of the shaft edge of the shaft 405, the platen holder 407 loosely supported on this rubber roller shaft 405 between the left and right rubber rollers 406, 406 is engaged at its rear part with the left and right platen levers 403, 403 through shafts $407_1$, $407_1$.

$405_1$, $405_1$ in FIG. 1 designate bearings for the rubber roller shaft 405, which are enabled to adjust the parallel alignment between the platen 401 and they type ring group 202 by fitting them in the longitudinally notched portions $403_1$, $403_1$ formed in the platen levers 403, 403 in a manner to freely determine their left and right positions.

A numeral 417 (FIGS. 1 and 21) refers to a printing paper guiding plate spring which is positioned along the lower surface of the platen holder 407 and the lower surface of the rubber rollers 406, 406, and fitted onto the lateral plate 404. By this plate spring 417, the printing paper PP in the rubber rollers 406, 406 is in a state of its being urged to the rubber roller surface.

The rollers 408, 408 mounted at both ends of the rubber roller shaft 405 is associated with a pair of left and right cams 114, 114 fixedly mounted on the cam shaft 103 of the driving mechanism 100, while the outwardly projecting pins 409, 409 of the left and right platen levers 403, 403 are associated with a pair of left and right cams 113, 113. These rollers 408, 408 have a function of giving reciprocating motion to the platen lever 403, 403 with the shaft 402 as the center.

Figure 23A:
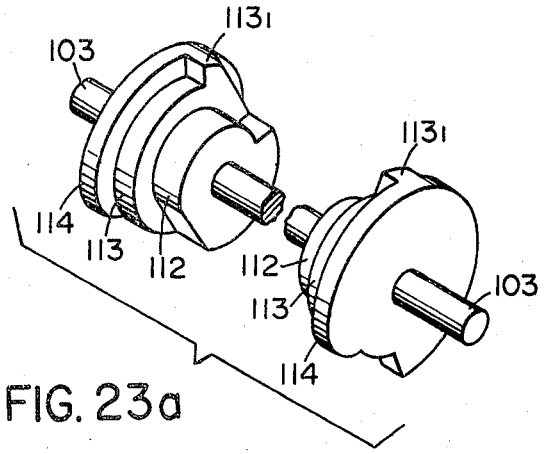
FIG. 23(*a*) is a perspective view of a pair of left and right cams to operate the platen mechanism.
Figure 23B:
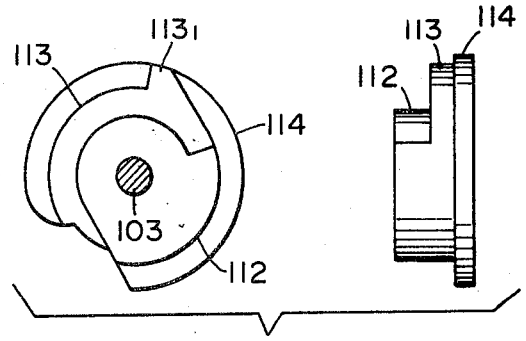
Figure 23C:
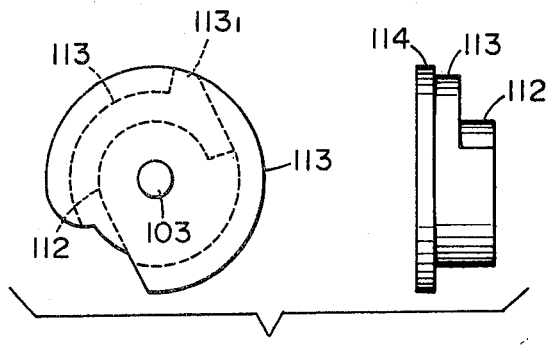

A pair of left and right cams 114, 113 fixedly mounted on the cam shaft 103 are integrally formed with a pair of left and right cams 112 for driving the ink roller mechanism to be described later. The height and phase of the cam surface of these left and right three-in-one integral cams 114, 113, and 112 are same and symmetrical, as seen in FIG. 23. The height of the cam surface of the cam 112 does not exceed the height of the cam surface of the cam 113. Similarly, the height of the cam surface of the cam 113 does not exceed the height of the cam surface of the cam 114. The ink roller shaft to be described later has a length which is only sufficient to contact the cam 112. The pins 409, 409 have their length sufficient to contact the cams 112, 113. The rollers 408, 408 have their length sufficient to contact at least the cam 114.

Figure 24A:
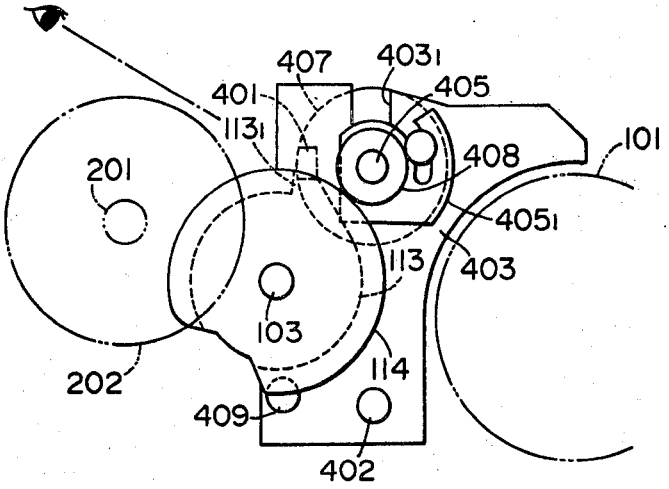
FIGS. 24(*a*) and 24(*b*) are respectively side elevational views showing a state, wherein the platen mechanism is away from the type ring, and a state, wherein the platen oscillates toward the type ring to be press-contacted to the type ring for effecting the character printing.
Figure 24B:
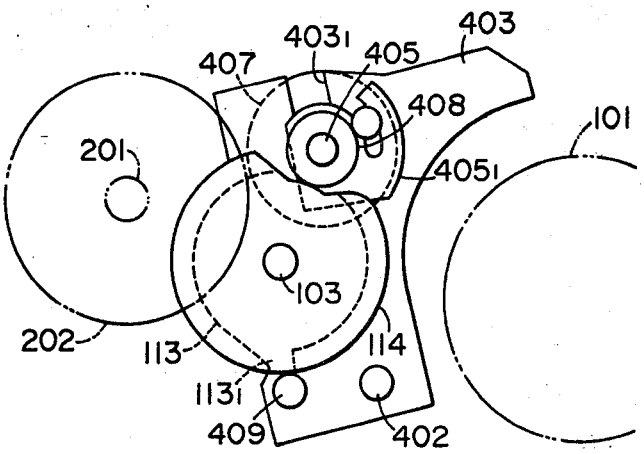

The platen lever 403 and the cams 114, 113 on the cam shaft 103 are in their respective states as shown in FIG. 24(*a*) during the stand-by-period of the printer, wherein it does not perform printing or paper forwarding operations. In more detail, the pin 409 is positioned in a small diameter part of the cam 113, and the roller 408 is positioned in contact with a large diameter part of the cam 114, whereby the platen lever 403 is maintained at a position away from the type ring group 202 with the shaft 402 as the center through the roller 408 by the large diameter part of the cam 114.

When the printer starts to operate, the platen cams 114, 113 rotate in the arrow direction a by the rotational force of the cam shaft 103. When the pair of left and right platen cams 114, 113 rotate approximately half way, the pin 409 is pushed by the projected part $113_1$ of the cam 113. Moreover, due to the roller 408 dropping into the notched portion of the cam 114, the platen lever 403 rotates in the direction toward the type ring group 202 with the shaft 402 as the pivot. And, as the platen lever 403 continues its rotation and its rotational quantity becomes maximum, the printing paper PP is urged to the type ring group 202 by the platen 401, whereby the printing is effected (FIG. 24(*b*)).

Thereafter, the projected part $113_1$ of the cam 113 is disengaged from the pin 409 by the continuing rotation of the platen cams 114, 113. Also, by engagement of the larger diameter part of the cam 114 and the roller 408, the platen lever 403 rotates again in the direction away from the type ring group 202 with the shaft 402 as the center of rotation to thereby return to the stand-by state shown in FIG. 24(*a*).

A play occurring between the platen cams 114, 113, the pin 409, and the return roller 408 can be absorbed by urging them in the reverse direction of the printing operation, i.e., in the direction opposite to the type ring group 202, with an appropriate force from a spring member (not shown).

Forwarding of the platen holder 407 and the printing paper PP wound around the platen 401 (FIG. 21) are performed in utilization of the abovementioned reciprocating motion which the platen lever 403 performs at the time of the printing operation.

Figure 25A:
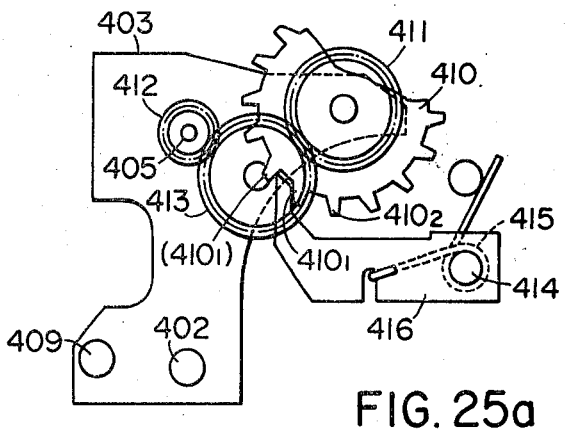
FIGS. 25(*a*), 25(*b*) and 25(*c*) respectively illustrate the paper forwarding step by a paper forwarding mechanism.
Figure 25B:
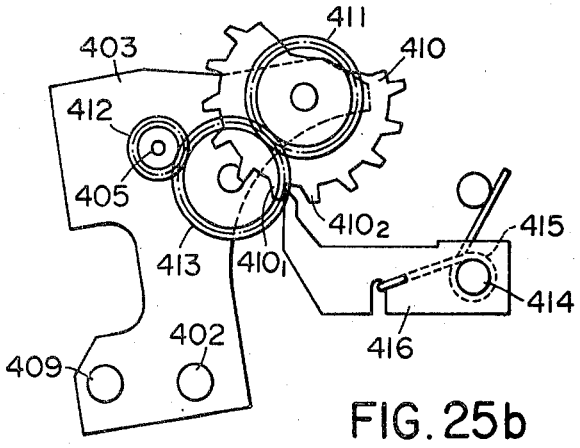
Figure 25C:
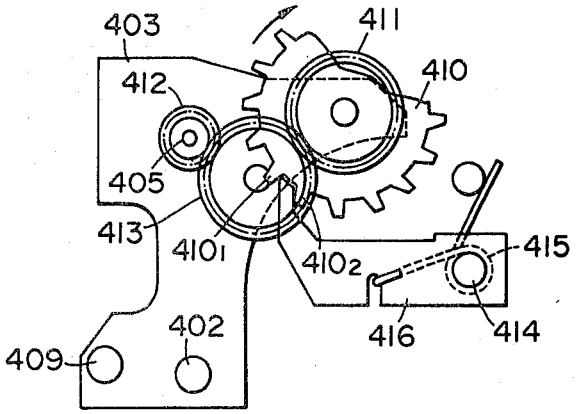

In more detail, while the platen lever 403 is ordinarily at its stand-by position shown in FIG. 25(*a*), it changes to a state at the time of the printing shown in FIG. 25(*b*), i.e., a state, wherein it is inclined in the direction of the type ring group with the shaft 402 as the center of oscillation. At this time, the plate spring 417 (FIGS. 1 and 21) urges the rubber roller 406 due to its spring force. Accordingly, the ratchet wheel 410, too, is restricted in its movement through the gears 412, 413 and 411. On account of this, the pawl $410_1$ on the circumference of the ratchet wheel 410 overcomes the force of the spring 415 pushing the pawl member 416 to depress the pawl member 416 and to run over the tip end of the pawl $410_1$ of the ratchet wheel 410. Thereafter, the platen 401 rotates to a position where it urges the type ring group 202, at which position the platen lever 403 once stops its motion. In this instance, the pawl $416_1$ at the tip end of the pawl member 416 is positioned between the pawl $410_1$ which has run over the tip end on the circumference of the ratchet wheel 410 and the subsequent pawl $410_2$ (FIG. 25(*b*)).

After printing, the platen lever 403 returns again to the state shown in FIG. 25(*c*), i.e., FIG. 25(*a*), where the ratchet tooth $410_1$ around the ratchet wheel 410 is engaged with the tip end of the pawl member 416 to be restricted in its movement, and rotationally moves upto a position ($410_1$) in FIG. 25(*a*). As the result of this, the rotation of this ratchet wheel 410 for one tooth is transmitted to the rubber roller shaft 405 through the gears 411→413→412, whereby the rubber rollers 406, 406 rotate and forwarding of the printing paper for one line is effected.

In this case, since the force to rotate the ratchet wheel 410 by the pawl member 416 is stronger than the force to stop the rotation of the rubber roller 406 by pressing the same, the ratchet wheel 410 rotates. Since the ratchet teeth around the ratchet wheel 410 are arranged at equal space intervals, the rubber roller 406 rotates for a certain definite angle at every printing cycle. Also, since the printing paper PP is urged to the rubber roller 406 by the plate spring 417, the printing paper PP is forwarded by a certain definite quantity by the frictional force between the rubber roller 406 and the printing paper PP (which is greater than the frictional force between the plate spring 417 and the printing paper PP). Further, the printing paper can be forwarded by manually rotating the ratchet wheel 410 in the arrow direction in FIG. 25(*c*).

Incidentally, while this type of printing device usually forwards the printing paper in a certain definite quantity after it is printed, it occurs frequently that the paper as printed is difficult to be observed because it is kept out of sight by the type ring, on account of which the paper forwarding quantity becomes inevitably excessive. However, by keeping the printing paper PP after it is printed apart from the type ring group 202 together with the platen lever 403 as in the present invention, there is no possibility of the printed paper being hidden from sight, and the printed letters and symbols can be easily observed (FIG. 24(*a*)).

Figure 26A:
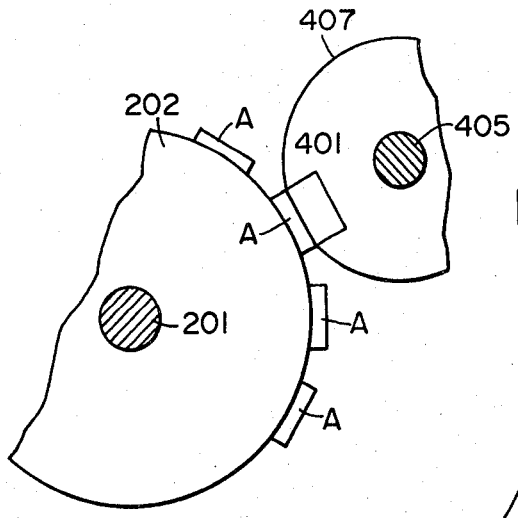
FIGS. 26(*a*), 26(*b*) and 26(*c*) are respectively side elevational views showing various embodimental shapes of the type face and the plate surface.
Figure 26B:
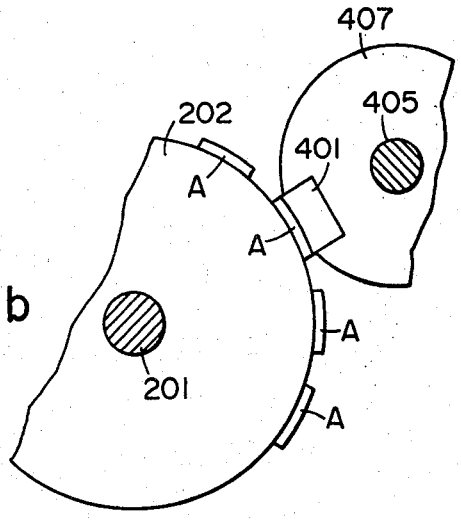
Figure 26C:
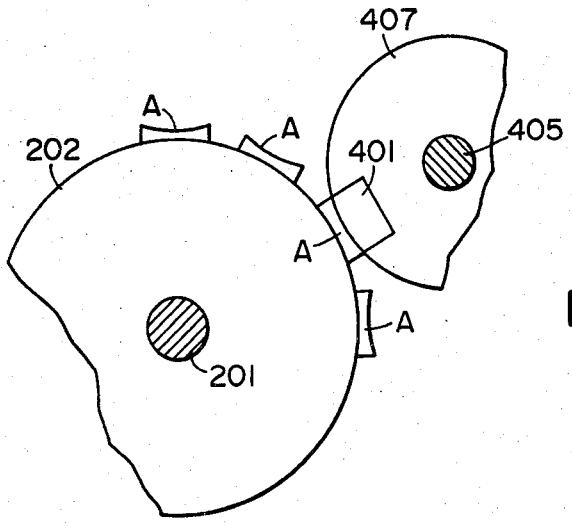
Figure 27:
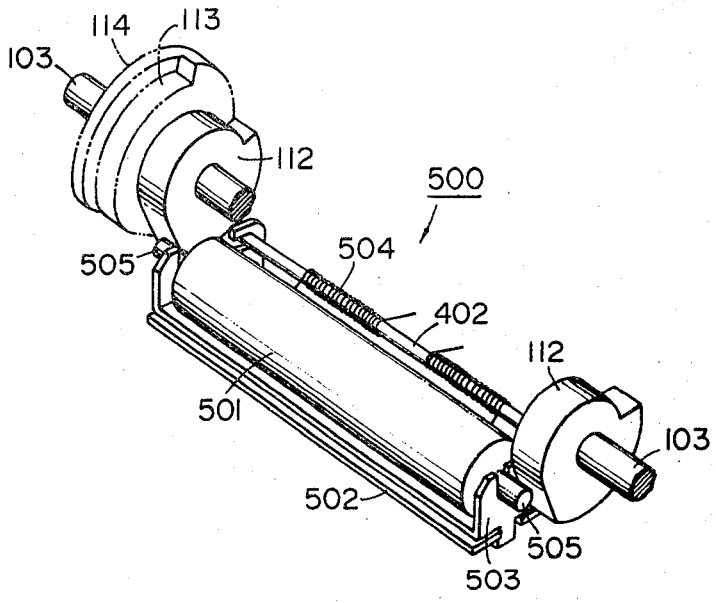
FIG. 27 is a perspective view of an ink roller mechanism.
Figure 28:
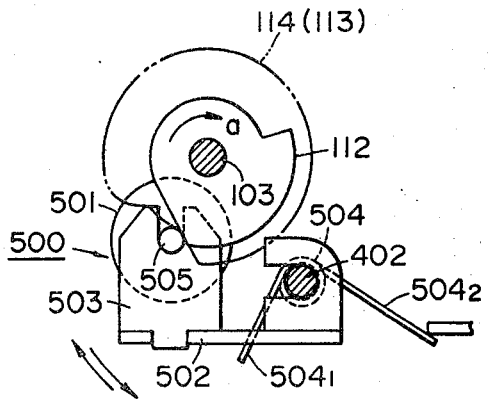
FIG. 28 is a side elevational view of the ink roller mechanism.

Further, in the printing device according to the present invention, the type face of the types A on the circumference of the type ring 202 for each place to be urged onto the platen 401 is made flat, and the impression surface of the platen 401 is also made flat (FIG. 26(*a*) with a view to improving the print quality.

For instance, if the face of the type A is made convex or arcuate as shown in FIG. 26(*b*), the impression surface of the platen 401 should be made concave in conformity to the arcuate surface of the type A, otherwise there inevitably takes place missing in the upper and lower parts of the characters, etc. as printed. In addition, when the impression surface of the platen 401 is made concave, there accrues such defect that a fold is produced on the printing paper by the upper and lower ends of the platen at the time of the impression.

In order to remove the defect in the surfacial shape between the type and the platen shown in FIG. 26(*b*), it is contemplated that the impression surface of the platen 401 is inversely made convex or arcuate as shown in FIG. 26(*c*). In this case, the surface of the type A should be made concave to prevent the printed characters, etc, from missing its upper and lower edges.

In this case, however, application of ink onto the type face of the ink roller 501 becomes difficult on the concave portion in the middle of each type.

The abovementioned defect can be eliminated substantially perfectly, if the radius of curvature of the convex and concave surface of the type A and the impression surface of the platen 401 is made as large as possible. Accordingly, the surface of the type A and the impression surface of the platen 401 of the present device are both made flat.

Moreover, in the printing device according to the present invention, the platen 401 is fixed to the platen holder 407, and the paper forwarding rubber rollers 406, 406 are disposed at both sides of the platen holder. The rubber rollers 406, 406 are both fixed to the rubber roller shaft 405, and the rubber roller shaft 405 passes through the interior of the platen holder 407 and is rotatable.

In contrast to this, when, for example, the platen roller is constructed by integrally forming the platen and the paper feeding rubber rollers, if the impression surface of the platen is made flat for the improvement in the print quality, etc. as mentioned above, it becomes an n-polyhedral pillar (n·n are integers equal to, or larger than, 3, i.e., $n \cdot n \geqq 3$ as shown in FIG. 22(*b*). In such case, the platen roller is required to have fairly high precision in its rotational angle at the time of its paper forwarding. Also, when the printing paper is pulled out by hand, there occurs such possibility that the platen roller rotates and stops at a position other than the predetermined one to wait for a print instruction. In this instance, the impression surface of the platen does not coincide with the type face at the time of the print, whereby print quality becomes remarkably inferior.

Since the printing device according to the present invention fixedly secures the platen 401 to the platen lever 403 through the platen holder 407, and performs the paper forwarding by the rubber rollers 406, 406 at both sides of the paper feeding platen 401, no precision is required of the rotational angle of the rubber rollers 406, 406 as is the case with the platen roller in FIG. 22(*b*). It is also possible to pull the printing paper PP by hand.

Ink Roller Mechanism 500 (FIGS. 1, 21, 27, 28)

The ink roller mechanism comprises an ink roller lever 502 rotatably supported on the rotational shaft 402 of the platen lever 403 of the abovementioned platen mechanism 400; an ink roller cassette 503 fitted on the ink roller lever 502; an ink roller 501 rotatably supported on the ink roller cassette 503; and a spring 504 which is loosely wound around the rotational shaft 402 with one end $504_1$ thereof being engaged with the ink roller lever 502 and with the other end $504_2$ thereof being engaged with a fixed plate of the device, and which constantly energizes the ink roller lever 502 in the direction of the type ring 202 with the shaft 402 as the center to urge the ink roller 501 to the external surface of the type ring.

During the returning period and the printing period of the type ring, the ink roller 501 is press-contacted to the type ring by the pressure of the spring 504, whereby the ink is applied onto the type ring. Further, during the stand-by period and the character selection period, the ink roller shaft 505 is engaged with the cam 212 which is fixedly secured to the cam shaft 113 of the driving mechanism 100 and rotates together with the shaft 103, whereby the ink roller 501, the ink roller cassette 503, and the ink lever 502 are all pushed downward against the spring 504 with the shaft 402 as the center, and the ink roller 501 is separated from the type ring.

Here, the spring 504 loosely wound around the shaft 402 can be elongated in the axial direction of the shaft 402. Therefore, the number of winding turns can be increased, and the spring constant can be made small, even if the spring pressure of the spring 504 is augmented, with the consequence that the motor torque required for the variable step in the mechanism for swinging the ink roller 501 can be reduced.

When the spring constant of the spring 504 is large, pressure of the ink roller 501 to the typ ring 202 varies due to its outer diameter changing with lapse of years, wear through its use, and fluctuation at the initial stage of its manufacture, whereby high print quality cannot be obtained. In order to prevent such variations in pressure, spring pressure is increased to reduce the spring constant, whereby the pressure of the ink roller 501 to the type ring 202 can be made uniform, and application of the ink onto the type A on the type ring 202 can be effected regularly to thereby yield the high print quality.

When the type ring 202 is rotated at high speed, the ink roller 501 oscillates due to irregularity on the type face on the outer periphery of the type ring, whereby the outer periphery of the ink roller separates from the type face to cause irregularity in the ink application to make it unable to produce high print quality. In order to prevent this, the spring pressure is made large to reduce the spring constant, whereby the oscillation of the ink roller can be made small. Thus, the high print quality can be obtained, and the speed increase in the printer is possible.

As already explained with reference to the type ring mechanism 200, the stopper members 211, 211 fixed on both sides of the type ring group 200 as an integral part of the type ring shaft have the functions of rotating the ink roller 501 together with the type ring in resilient contact with both end parts of the ink roller 501 during the period when the ink roller 501 contacts the type ring group 202, and of preventing the type ring ratchet wheel 209 from being overloaded and broken, in case, for example, the ink roller 501 should be rotated with only one character in the type. Also, the notched sections $\mathbf{211}_2$, $\mathbf{211}_2$ formed in the stopper members 211, 211 has a function of avoiding the stopper members from contacting the plate spring 417. The outer peripheral surface of the stopper members 211, 211, except for the notched parts, is provided with frictional knurling.

In the following, more detailed explanations will be given in reference to the timing chart in FIG. 5 as to associated works of each mechanical section in one print cycle, i.e., in one rotational process of the cam shaft 103.

The previous print cycle is terminated by interruption of electric conduction to the motor 101 by the signal $T_{13}$ from the signal generating mechanism 300, although the motor 101 is unable to stop instantaneously due to its force of inertia, even when the signal $T_{13}$ is generated, but it stops on the approximately half way of its returning step. The electric current again flows through the motor 101 by the subsequent print instruction, whereby it starts rotation, and the cam shaft 103 also rotates accordingly, whereby the subsequent one print cycle is started, in the following sequence.

(1) Operations in the latter half of the type ring returning period (cam shaft 103 rotates for an angle of from 214.28° to 317.14°)

(a) Reverse rotation of the type ring 202:

The gear 206 of the type ring shaft 201 is meshed with the intermediate point of the sector teeth portion of the intermittent gear engaged with the cam shaft 103 which has started rotation through the reset gear 205, so that the type ring shaft 201 reversely rotates in the direction Q, and the type A (O) on each of the type rings 202 are aligned in the front face of the ink roller 501. Thereafter, the sector-shaped teeth portion of the intermittent gear 110 is separated from the reset gear 205, and the rotational force to the type ring 202 is interrupted, and the type ring shaft 201 and the type rings 202 are stopped.

(b) Press-contact and ink transfer of the ink roller 501;

In the return step, the ink roller shafts 505, 505 are disengaged from the ink roller variable cams 112, 112. Since the ink roller 501 is press-contacted to the type ring 202 by the spring 504, it applies ink onto the type faces on the type rings 202 upon rotation.

(c) The leaf spring 217 engaged with the selection pawl 208 starts pressure application from its state of maintaining a reduced pressure:

Since the leaf spring fitting lever 218 fitted onto the leaf spring 217 is disengaged from the leaf spring variable cam 117 on the cam shaft 103, and the armature 213 of the selection pawl 208 is returned in the attracting direction of the permanent magnet 215 of the electromagnetic device by means of the return springs $\mathbf{217}_2$, $\mathbf{217}_2$ at both ends of the leaf spring 217, the selection pawl 208 is maintained in its reset state and urges the armature to the yokes $\mathbf{214}_1$, $\mathbf{214}_1$.

If this period (the period, in which the armature 213 is attracted to the yokes $\mathbf{214}_1$, $\mathbf{214}_1$ in its return step) is long, there tend to occur adverse effects to the armature and yokes by vibrations of the printing device, dirts, etc. Therefore, the pressing time by the leaf spring 217 in engagement with the selection pawl 208 should preferably be the minimum required. At the end of the return step, the leaf spring variable cams 117, 117 begin to be engaged with the end part of the leaf spring fitting lever 218 to gradually apply the pressure to the leaf spring 217.

(d) No signal generation:

After generation of the signal $T_{13}$ from the signal generating mechanism 300, the positioning cam 116 engaged at the side surface of the intermittent gear 115 becomes engaged with the positioning cam 306 engaged at the side surface of the gear 302. Since the gear 302 is in stoppage, the reed switch 305 does not operate, hence no signal is generated.

(e) Stoppage of the platen mechanism:

As mentioned in the foregoing, the platen mechanism 400 is designed in a structure, wherein it is partially made common with a part of the paper feeding mechanism. After the print step, the platen mechanism is separated from the type ring 202, and is stopped.

(f) Stoppage of the paper forwarding mechanism:

Since the printing step has terminated before the signal $T_{13}$ is generated, the paper feeding mechanism is in stoppage.

(2) Operations during stoppage of the type ring (the cam shaft 103 rotates for an angle of from 317.14° to 360°)

(a) Stoppage of the type rings:

The reset gear 205 is in a stopped state, because the positioning cam 111 mounted on the rotating cam shaft 103 is engaged with the positioning cam 207, and the rotational force of the cam shaft 103 is not transmitted to the reset gear 205 engaged with the positioning cam 207. Accordingly, the type ring gear 206 which is meshed with the reset gear 205 and the type ring 202 are also stopped, whereby the types A (O) on the type rings 202 are aligned in the front face of the ink roller.

(b) Separation of the ink roller 501 from the type ring 202:

The ink roller 501 press-contacted to the type ring 202 is engaged with the ink roller variable cams 112, 112 of the cam shaft 103, and separated from the type ring 202, thereby maintaining the state. If this operation is not stable, there is imposed a load onto the type ring 202 in the course of the character selection step to bring it in engagement with the pawl $209_4$ of the ratchet wheel 209, and the type ring engaged by the spring force of the ratchet wheel is disengaged to result in erroneous printing.

(c) Pressure application by the leaf spring engaged with the selection pawl:

The leaf spring 217 which is engaged with the selection pawl 208 is rotating to such an extent of pressure that the armature 213 engaged with the selection pawl 208 does not exceed the attractive force of the electromagnetic device in the opposite direction. The plate spring fitting lever 218 engaged with the plate spring variable cams 117, 117 which is engaged with the cam shaft 103 shifts bit by bit to press the leaf spring 217. When the pressure is applied abruptly, the armature 213 is subjected to vibrations, whereby instability is caused to the armature 213 in its attracted state. Also, load to the motor 101 increases, hence the device becomes large in construction.

(d) No signal generation:

Same as (1)-(d) above.

(e) Stoppage of the platen mechanism:

Same as (1)-(e) above.

(f) Stoppage of the paper forwarding mechanism:

Same as (1)-(f) above.

(3) Operations during the character selection step (the cam shaft rotates for an angle of from 0° to 135°)

(a) Forward rotation of the type ring:

As explained above with reference to the driving mechanism 100, the type ring shaft 201 forwardly rotates in the direction P through the gear 108 on the cam shaft 103, and the type ring shaft gear 203, along with which the type ring 202 for each place rotates forwardly.

(b) Separation of the ink roller from the type ring:

The ink roller shafts 505, 505 are engaged with the ink roller variable cams 112, 112, whereby the ink roller 501 is separated from the type ring and maintained in that state.

(c) Pressure application by the leaf spring engaged with the selection pawl:

The leaf spring fitting lever 218 is engaged with the selection pawl 208 in a state of being pressed to a spring pressure which does not exceed the attractive force of the yokes $214_1$, $214_1$ by means of the leaf spring variable cams 117, 117 mounted on the cam shaft 103.

(d) Generation of signals $T_0$ to $T_{12}$:

The signals $T_0$ to $T_{12}$ required for stopping the required types on the type rings 202 in front of the impression surface of the platen are generated from the signal generating mechanism 300. In other words, the sector-shaped gear $115_1$ of the intermittent gear 115 having an angle of 108° and mounted on the cam shaft 103 causes the gear 302 to rotate, whereby the magnet disc 301 rotates to actuate the reed switch 305, and the signals $T_0$ to $T_{12}$ are generated.

(e) Bit by bit forwarding of the platen mechanism:

From the latter half of the character selection step, the projected parts $113_1$, $113_1$ of the platen variable cams 113, 113 which are mounted on the cam shaft 103 are engaged with the pins 409, 409 fixed to the side surface of the platen levers 403, 403 whereby the platen mechanism 400 starts moving toward the type ring group 202.

(f) Stoppage of paper forwarding:

As described in the foregoing, the platen mechanism 400 and the paper forwarding mechanism are made common each other. Therefore, the printing paper PP press-contacted to the paper forwarding rollers 406, 406 is not forwarded, even when the platen mechanism 400 becomes movable in the direction of the type rings 202.

(4) Operations during the printing step (the cam shaft rotates for an angle of from 135° to 188.57°)

As soon as the type ring shaft 201 stops its rotation and the character selection step has terminated, the characters to be printed are aligned in the front face of the platen over all the numerical places. Then, the platen 401 press-contacts the type rings, and the ink on the type is transferred onto the printing paper PP wound around the outer periphery of the platen 401. Thereafter, the platen 401 is separated from the type ring, and the impression operation ends.

(a) Stoppage of the type rings:

The cam 109 of the cam shaft 103 is engaged with the cam 204 of the type ring shaft 201, and the type ring is stopped.

(b) Commencement of press-contact of the ink roller to the type rings:

About half way of the printing step, the ink roller shafts 505, 505 are engaged with the ink roller variable cams 112, 112, and the ink roller 501 is separated from the type rings 202. However, as soon as the platen 401 contacts the type rings 202, the ink roller shafts 505, 505 of the ink roller 501 separate from the ink roller variable cams 112, 112, whereby the ink roller 501 is press-contacted to the type rings 202 by force of the spring 504.

(c) Commencement of pressure reduction of leaf spring engaged with the selection pawl:

Up to about the half way point of the printing step, the leaf spring 217 is pressed by the leaf spring variable cams 117, 117. Substantially simultaneously with press-contact of the platen 401 to the type rings 202, the leaf spring fitting lever 218 and the leaf spring variable cams 117, 117 are released from their engagement, whereby the pressure is reduced, the pawl $208_1$ of the selection pawl 208 is separated from the ratchet teeth B fitted on the side surface of the type rings 202 by the return springs $217_2$, $217_2$ attached to the left and right ends of the plate spring 217. At the same time, the armature 213 engaged with the selection pawl 208 is attracted to the yokes $214_1$, $214_2$ of the electromagnetic device by the pressure of the return springs $217_1$, $217_2$.

(d) No signal generation:

The positioning cam 116 fixed on the side surface of the intermittent gear 115 is engaged with the positioning cam 306 fixed on the side surface of the gear 302. This engagement makes the gear 302 unable to rotate with the result that the reed switch 305 does not operate.

(e) Press-contact of the platen to the type rings:

Characters to be printed are aligned in the front face of the platen over all the numerical places. Then, the platen 401 moves toward the type rings 202 due to engagement of the projections $113_1$, $113_1$ of the platen variable cams 113, 113 with the pins 409, 409 on the platen levers 403, 403 being in a pressed state to the type rings, whereby the ink on the types is transferred onto the printing paper PP wound around the outer periphery of the platen. Thereafter, the large diameter part of the platen return cams 114, 114 are engaged with the return rollers 408, 408 axially supported on the paper forwarding roller shaft 405, and the platen 401 separates from the type rings 202.

(f) Commencement of paper forwarding from stoppage:

While the platen mechanism 400 is moving in the direction of the type rings 202 (impressing direction), no paper forwarding is effected. When the platen mechanism 400 returns from the type rings 202, the paper forwarding rubber rollers 406, 406 rotate by the operations of the pawl member 416, the ratchet wheel 413, and the gear 412, whereby the paper forwarding is effected.

(5) Operations during the former half of the type rings returning period (the cam shaft 103 rotates for 188.57° to 214.28°)

When the printing operation ends, the type ring rotational shaft 201 rotates in the direction Q, and the type ring 202 for each place commences its return to the original position.

During this period, the pawl $209_4$ of the ratchet wheel 209 engaged with the type ring rotational shaft 201 drops again into the notched portion $C_1$, whereby the type ring rotational shaft 201 and the type ring 202 are mutually engaged and continue their rotation until the types A (0) align in the front face of the ink roller 501. In this case, however, as the signal $T_{13}$ is generated on the way, and the power source for the motor 101 is interrupted. As the result, the rotation is stopped on the way.

(a) Commencement of reverse rotation of type rings:

The intermittent gear 110 on the cam shaft 103 is meshed with the reset gear 205, the rotation of which is transmitted to the type ring shaft gear 206, and the type ring rotational shaft 201 reversely rotates in the direction Q, whereby the type rings start their reverse rotation.

While the gear 110 is meshed with the reset gear 205, the signal $T_{13}$ is generated, the power source for the motor 101 is interrupted, and the cam shaft 103 stops, whereby the gear 110 and the reset gear 205 stop in their meshed state.

(b) Press-contact and ink transfer of the ink roller to the type rings:

The ink roller variable cams 112, 112 mounted on the cam shaft 103 are disengaged from the ink roller shafts 505, 505, and the ink roller 501 is pressed by the spring 504 to press-contact the type ring 202. When the type rings 202 rotate, the ink roller 501 rotates and the ink is applied onto the outer periphery of the type rings.

(c) Pressure reduction in the leaf spring engaged with the selection pawl:

The leaf spring fitting lever 218 and the leaf spring pressing cams 117, 117 are mutually disconnected, and the armature 213 engaged with the selection pawl 208 by means of the left and right return springs $217_2$, $217_2$ is in a state of being attracted to the yokes $214_1$, $214_2$ of the electromagnetic device.

(d) Generation of signal $T_{13}$:

The positioning cam 116 fixed on the side surface of the intermittent gear 115 is engaged with the positioning cam 306 fixed on the side surface of the gear 302, whereby the gear 302 stops, the magnet disc 301 also stops its rotation, and the reed switch 305 does not operate, there is no signal generation.

Thereafter, while the cam shaft 103 is rotating, the the cam 116 engaged with the intermittent gear 115 is separated from the gear 302, and the toothed portion $115_3$ of the intermittent gear 115 is meshed with the gear 302 to rotate the gear for an angle of 25.8°, whereby the magnet disc 301 rotates by ½ and the reed switch 305 is operated by the permanent magnet $mg_2$ to generate the signal $T_{13}$.

With this signal $T_{13}$, the power source for the motor 101 is interrupted, and the motor 101 stops its rotation. Thereafter, the motor 101 slightly rotates by its inertia, and stops in the state of the positioning cam 116 on the intermittent gear 115 being engaged with the positioning cam 306 on the gear 302.

(e) Return of platen from the type rings:

The return rollers 408, 408 of the paper forwarding rubber roller shaft 405 is engaged with the large diameter part of the platen cams 114, 114, and the platen 401 is away from the type rings 202 and stops at a position most distant from the type rings 202.

(f) Completion of paper forwarding operation:

As already explained in respect of the platen mechanism 400, the paper forwarding operation is performed in utilization of the moving quantity of the platen 401 returning from the type rings 202, and the paper forwarding operation is complete when the platen is the most distant from the type rings 202.

Figure 29:
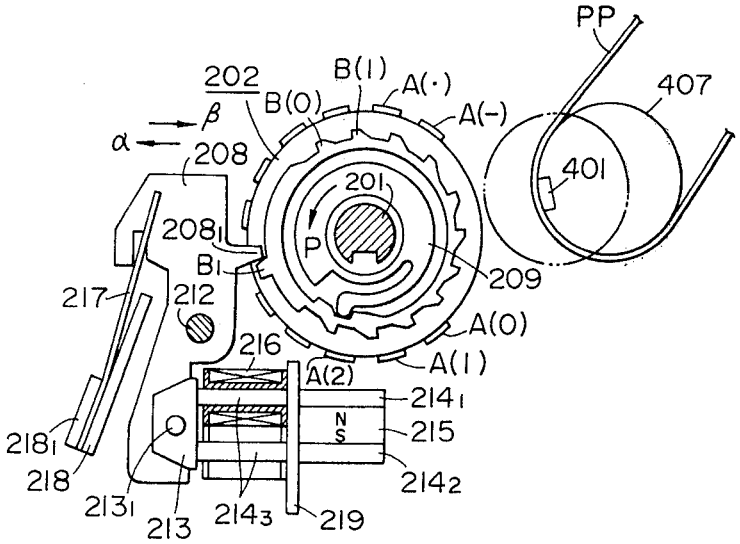
FIG. 29 illustrates the type ring and the type selection lever in their stand-by state.

Incidentally, the type ring selection lever 208 for each place in the above-described printing device in the state of the type ring 202 being returned to their positions for alignment is attracted to and maintained by the tip ends $214_3$, $214_3$ of the comb teeth of the yokes $214_1$, $214_2$ by the magnetic flux of the permanent magnet 215 through the armature 213 fitting at the bottom end part of the lever as shown in FIG. 29, and the lever 208 is held in a reset state where in it is rotates in the direction $\alpha$ with the shaft 212 as the center of its oscillation. Also, a force which tends to rotate the lever 208 in the direction $\beta$ opposite to the abovementioned direction $\alpha$ with the shaft 212 as the center is acting on the lever 208 from the plate spring 217, although the force is weaker than the armature attracting and holding force of the abovementioned yoke comb teeth tip ends $214_3$, $214_3$.

Figure 30:
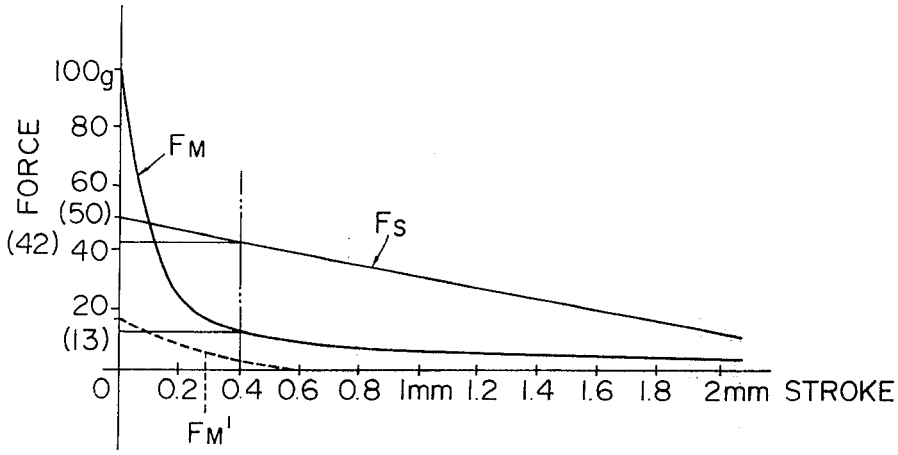
FIG. 30 is a graphical representation showing a relationship between the attractive force of the magnet and the spring force of the leaf spring.

Explaining this force relationship in reference to the curve $F_M$ for the armature attracting force of the yoke comb teeth tip ends $214_3$, $214_3$ and the curve $F_S$ for the spring force of the leaf spring 217, as shown exemplarily in FIG. 30, the armature 213 is attracted to the tip ends 214$_3$, 214$_3$ of the yoke comb tooth with an attractive force of 100 g, in the state of the armature 213 being closely adhered to the yoke comb teeth tip ends 214$_3$, 214$_3$ with a stroke of 0 mm as mentioned above, while a force of 50 g is acting thereon by the leaf spring 217 in the direction opposite to the force of attraction. As the result of this, the armature 213 is attracted and maintained to the tip ends 214$_3$, 214$_3$ of the yoke comb teeth with a force of 50 g (100 g−50 g=50 g), whereby the lever 208 can be maintained in its normal reset state.

However, if it is supposed that a dust particle of 0.4 mm in diameter, for example, intrudes between the armature 213 and the tip ends 214$_3$, 214$_3$ of the yoke comb teeth, the clearance between them is widened by 0.4 mm. In this state, the force relationship between the armature attractive force of the tip ends 214$_3$, 214$_3$ of the yoke comb teeth and the spring force of the leaf spring 217 is such that the armature attracting force $F_M$ of the tip ends 214$_3$, 214$_3$ of the yoke comb teeth is 13 g, and the spring force $F_S$ of the leaf spring 217 is 42 g, as is understandable from FIG. 30. As the result, the force which tends the lever 208 of the leaf spring 217 to rotate in the direction $\beta$ with the shaft 212 as the center is greater than the armature attracting force of the tip ends 214$_3$, 214$_3$ of the yoke comb teeth (i.e., 13 g−42 g=−29 g), whereby the armature 213 is not attracted and maintained on the tip ends 214$_3$, 214$_3$ of the yoke comb teeth. In other words, the lever 208 is in an unsatisfactory reset condition.

In this state, when the printing device enters into the character selecting step, the type ring shaft 201 starts its rotation in the direction P, and the type ring 202 also starts rotation together with the shaft 201, the lever 208 in such unsatisfactory reset condition becomes engaged without failure by its pawl 208$_1$ with the first type selection tooth B (0), i.e., the type selecting tooth B (0) corresponding to the type A (0), and causes the type ring 202 to stop its rotation, because it is rotationally energized in the direction $\beta$ by the leaf spring 217 with the shaft 212 as the center as mentioned above, whereby the types A (0), i.e., a numeral "0", is selected in front of the platen 401. That is, not to say of a case where the type selection from the type ring 202 in the lever 208 in its unsatisfactory reset condition happens to be "0", even in case other numerals are selected, there will be erroneously selected the type A (0).

For example, when numerals "1 2 3 4" in four places are printed, if there takes place the inaccurate resetting with the type selection lever 208 in the third numerical place, the numerals will inevitably printed erroneously as "1 0 3 4". Since, in this case, the printing device is running at a high speed, such erroneous printing of "1 0 3 4" instead of "1 2 3 4" can hardly be recognized by an operator, and, moreover, it is difficult to judge whether it is an error or not. If this kind of erroneous printing occurs at a place where money is handled such as cashier's counter, etc., there occurs an erroneous difference of ¥1,234−¥1,034=¥200. Such erroneous difference would be detrimental to the goodwill of the business concerned. However, since the printing device is used under various conditions, there can be given no assurance that such erroneous operation would not occur absolutely.

The printing device according to the present invention in another aspect thereof is to provide a mechanism for judging that, at a glance of the printed format, the printed line contains any erroneous print, if this kind of erroneous printing operation occurs.

Figure 31:
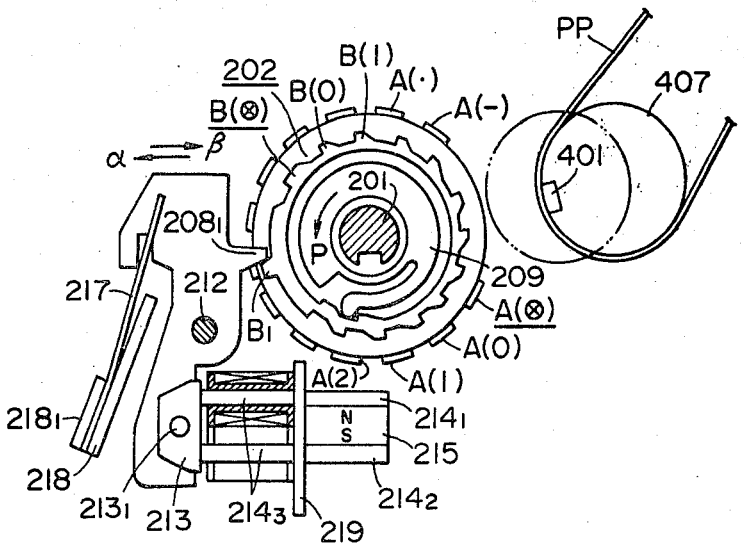
FIG. 31 illustrates the type ring provided with an erroneous operation warning mark, and the type selection lever in their stand-by state.

In more detail, as shown in FIG. 31, an erroneous operation warning mark type, e.g., a marking type A (⊕) in the form of "⊕" is provided as the first type to be sequentially provided on the outer periphery of the type rings 202. In other words, such erroneous operation warning mark type A (⊕) is provided before the numeral "zero" type A (0), and the type selection tooth B (⊕) corresponding to the mark type A (⊕) is provided in front of the type selection tooth B (0) corresponding to the "zero" type A (0).

Figure 32:
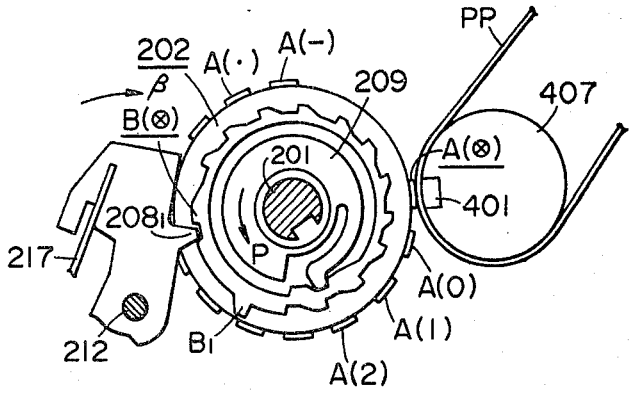
FIG. 32 shows a state, wherein the erroneous operation warning mark type has been selected.

When constructing the printing device as such, the pawl 208$_1$ of the type selection lever 208 which is in the inadequate reset condition due to intrusion of dust particles, etc., as already mentioned in the foregoing, becomes inevitably engaged with the first type selection tooth B (⊕), i.e., the tooth B (⊕) corresponding to the erroneous operation warning mark type A (⊕), at the initial stage of the type selection step to cause the type rings 202 to stop, whereby the erroneous operation warning mark type A (⊕) is selected in front of the platen 401, as shown in FIG. 32.

Accordingly, when the four-place numerals "1 2 3 4"are printed as in the previous embodiment, the print of the numerals where the type selection lever 208 at the third numerical place is in the inadequate resetting condition appears at "1 ⊕ 3 4 " (in the previous embodiment, the numerals are printed as "1 0 3 4").

That is to say, the print of the numerals on the numerical places where the erroneous operation have taken place is denoted by the erroneous operation warning mark "⊕" without exception, so that the operator could know from reading of the print format where the mark "⊕" is printed that the printing device is performed the erroneous printing operation.

Incidentally, by providing the erroneous operation warning mark A (⊕) before the "zero" type A (0), as mentioned above, the "zero" type A (0) becomes the second type. This "zero" type A (0) which is the second type is printed by the use of an interval between the first and second emissions of the timing signal T (the timing chart in FIG. 5) to be generated in synchronism with the type rings 202.

What we claim is:

1. A printer comprising:

A type ring rotatably mounted on a first shaft and having a plurality of types arranged on the outer periphery thereof;

a ratchet wheel, rotatably mounted on said first shaft and provided on a side of said type ring, for selecting said plurality of types;

a type selection lever engageable with said ratchet wheel;

a leaf spring engaged with an end of said type selection lever;

electromagnetic means for attracting said leaf spring to cause said type selection lever to engage said ratchet wheel to prevent rotation of said type ring on said first shaft;

means for urging said leaf spring to increase the force applied by said leaf spring when one of said plurality of types to be printed in selected and said type ring having the one of said plurality of types is stopped by said type selection lever, said urging means including:

a urging cam fixed on a second shaft;

pressing cam fixed on said second shaft for pressing a platen to said plurality of types;

separation cam fixed on said second shaft for separating an ink roller from said plurality of types; and a gear fixed on said second shaft for driving a signal generating unit which generates signals corresponding to each of said types and a signal for stopping a motor which rotates said second shaft, said urging cam, said separation cam and said gear being rotated by the rotation of said second shaft, whereby driving force is transmitted to all components provided in said printer through said cams and said gear.

2. A printer according to claim 1, wherein said motor is connected to said first shaft for rotating said type ring, and wherein said urging means further includes a cam coupled to said motor and a lever engaged with said cam and connected to said leaf spring.

* * * * *

UNITED STATES PATENT AND TRADEMARK OFFICE

CERTIFICATE OF CORRECTION

PATENT NO. : 4,424,743

DATED : January 10, 1984

INVENTOR(S) : KOZO OKUBO, et al.

It is certified that error appears in the above-identified patent and that said Letters Patent is hereby corrected as shown below:

Cover page, In "References Cited":For U.S. Patent No. 3,500,437, "Foerskr" should read --Foerster--;
In"References Cited":For U.S. Patent No. 3,884,144, "6/1975" should read --5/1975--.

Column 1, line 66, after "force" insert --of--.

Column 3, line 15, "cham" should read --cam--.

Column 4, line 24, "cham" should read --cam--;
line 54, "bear" should read --gear.

Column 6, line 25, "of the types" should read --type--.

Column 9, line 35, "plage" should reag --plate--.

Column 10, line 7, "as" should read --so--;
line 8, delete "to";
line 49, "megnet" should read --magnet--.

UNITED STATES PATENT AND TRADEMARK OFFICE

CERTIFICATE OF CORRECTION

PATENT NO. : 4,424,743

DATED : January 10, 1984

INVENTOR(S) : KOZO OKUBO, et al.

It is certified that error appears in the above-identified patent and that said Letters Patent is hereby corrected as shown below:

Column 13, line 23, "roller" should read --rollers--;
line 30, "secures" should read --secured.

Column 18, line 2, delete "on the.

Column 22, line 21, before "there" insert --hence;
line 57, "where in it is rotates" should be --where it is rotated--.

Column 23, line 52, after "inevitably" insert --be--.

Column 24, lines 5, 8, 10, 18, 19, 22, 28, 33, 35, 38, "⊕" should read -- ⊗ --;
line 36, "is" should read --has--.

Column 24, line 48 (Claim 1), "A" should be --a--;
line 68 (Claim 1), "a urging" should be --an urging--.

Signed and Sealed this

Third Day of July 1984

[SEAL]

Attest:

GERALD J. MOSSINGHOFF

Attesting Officer

Commissioner of Patents and Trademarks